US007299864B2

(12) United States Patent
Pratt et al.

(10) Patent No.: US 7,299,864 B2
(45) Date of Patent: Nov. 27, 2007

(54) ADJUSTABLE WINDOW LINER

(75) Inventors: Christopher A. Pratt, Cochrane (CA); Bruno H. Walter, St. Albert (CA)

(73) Assignee: CDX Gas, LLC, Dallas, TX (US)

( * ) Notice: Subject to any disclaimer, the term of this patent is extended or adjusted under 35 U.S.C. 154(b) by 164 days.

(21) Appl. No.: 11/021,055

(22) Filed: Dec. 22, 2004

(65) Prior Publication Data

US 2006/0131026 A1 Jun. 22, 2006

(51) Int. Cl.
*E21B 43/14* (2006.01)

(52) U.S. Cl. ..... 166/50; 166/313; 166/117.6

(58) Field of Classification Search ..... 166/313, 166/50, 242.5, 117.5, 117.6
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |
| 1,520,737 | A | 12/1924 | Wright |
| 1,674,392 | A | 6/1928 | Flansburg |
| 1,777,961 | A | 10/1930 | Capeliuschnicoff |
| 2,018,285 | A | 10/1935 | Schweitzer et al. |
| 2,069,482 | A | 2/1937 | Seay |
| 2,150,228 | A | 3/1939 | Lamb |
| 2,169,718 | A | 8/1939 | Böll et al. |
| 2,335,085 | A | 11/1943 | Roberts |
| 2,397,070 | A | 3/1946 | Zublin |
| 2,450,223 | A | 9/1948 | Barbour |
| 2,490,350 | A | 12/1949 | Grable |
| 2,679,903 | A | 6/1954 | McGowen, Jr. et al. |
| 2,726,063 | A | 12/1955 | Ragland et al. |
| 2,726,847 | A | 12/1955 | McCune et al. |

(Continued)

FOREIGN PATENT DOCUMENTS

| | | |
|---|---|---|
| CA | 2 278 735 | 1/1998 |

(Continued)

OTHER PUBLICATIONS

McCray, Arthur, et al., "*Oil Well Drilling Technology*," University of Oklahoma Press, 1959, Title Page, Copyright Page and pp. 315-319 (7 pages).

(Continued)

*Primary Examiner*—David Bagnell
*Assistant Examiner*—Giovanna M Collins
(74) *Attorney, Agent, or Firm*—Fish & Richardson P.C.

(57) ABSTRACT

A system for lining a junction between a main bore and an auxiliary bore includes a first tubing adapted to line at least a portion of the main bore. The first tubing has a lateral opening therein. A second tubing has a junction shield extending outward therefrom. The junction shield has a larger transverse dimension than the lateral opening and is adapted to contract to a smaller transverse dimension to pass through the lateral opening into the auxiliary bore.

18 Claims, 14 Drawing Sheets

U.S. PATENT DOCUMENTS

| | | | | |
|---|---|---|---|---|
| 2,783,018 | A | | 2/1957 | Lytle |
| 2,797,893 | A | | 7/1957 | McCurne et al. |
| 2,804,926 | A | | 9/1957 | Zublin |
| 2,847,189 | A | | 8/1958 | Shook |
| 2,911,008 | A | | 11/1959 | Du Bois |
| 2,980,142 | A | | 4/1961 | Turak |
| 3,208,537 | A | | 9/1965 | Scarborough |
| 3,215,204 | A | | 11/1965 | Sims |
| 3,347,595 | A | | 10/1967 | Dahms et al. |
| 3,443,648 | A | | 5/1969 | Howard |
| 3,473,571 | A | | 10/1969 | Dugay |
| 3,503,377 | A | | 3/1970 | Beatenbough et al. |
| 3,528,516 | A | | 9/1970 | Brown |
| 3,530,675 | A | | 9/1970 | Turzillo |
| 3,684,041 | A | | 8/1972 | Kammerer, Jr. et al. |
| 3,692,041 | A | | 9/1972 | Bondi |
| 3,757,876 | A | | 9/1973 | Pereau |
| 3,757,877 | A | | 9/1973 | Leathers |
| 3,800,830 | A | | 4/1974 | Etter |
| 3,809,519 | A | | 5/1974 | Garner |
| 3,825,081 | A | | 7/1974 | McMahon |
| 3,828,867 | A | | 8/1974 | Elwood |
| 3,874,413 | A | | 4/1975 | Valdez |
| 3,887,008 | A | | 6/1975 | Canfield |
| 3,902,322 | A | | 9/1975 | Watanabe |
| 3,907,045 | A | | 9/1975 | Dahl et al. |
| 3,934,649 | A | | 1/1976 | Pasini, III et al. |
| 3,957,082 | A | | 5/1976 | Fuson et al. |
| 3,961,824 | A | | 6/1976 | Van Eek et al. |
| 4,011,890 | A | | 3/1977 | Andersson |
| 4,022,279 | A | | 5/1977 | Driver |
| 4,037,658 | A | | 7/1977 | Anderson |
| 4,073,351 | A | | 2/1978 | Baum |
| 4,089,374 | A | | 5/1978 | Terry |
| 4,116,012 | A | | 9/1978 | Abe et al. |
| 4,134,463 | A | | 1/1979 | Allen |
| 4,156,437 | A | | 5/1979 | Chivens et al. |
| 4,169,510 | A | | 10/1979 | Meigs |
| 4,189,184 | A | | 2/1980 | Green |
| 4,220,203 | A | | 9/1980 | Steeman |
| 4,221,433 | A | | 9/1980 | Jacoby |
| 4,224,989 | A | | 9/1980 | Blount |
| 4,257,650 | A | | 3/1981 | Allen |
| 4,278,137 | A | | 7/1981 | Van Eek |
| 4,283,088 | A | | 8/1981 | Tabakov et al. |
| 4,296,785 | A | | 10/1981 | Vitello et al. |
| 4,299,295 | A | | 11/1981 | Gossard |
| 4,303,127 | A | | 12/1981 | Freel et al. |
| 4,303,274 | A | * | 12/1981 | Thakur ..... 299/12 |
| 4,305,464 | A | | 12/1981 | Masszi |
| 4,312,377 | A | | 1/1982 | Knecht |
| 4,317,492 | A | | 3/1982 | Summers et al. |
| 4,328,577 | A | | 5/1982 | Abbott et al. |
| 4,333,539 | A | | 6/1982 | Lyons et al. |
| 4,354,558 | A | | 10/1982 | Jageler et al. |
| 4,366,988 | A | | 1/1983 | Bodine |
| 4,372,398 | A | | 2/1983 | Kuckes |
| 4,386,665 | A | | 6/1983 | Dellinger |
| 4,390,067 | A | | 6/1983 | Willman |
| 4,396,075 | A | | 8/1983 | Wood et al. |
| 4,396,076 | A | | 8/1983 | Inoue |
| 4,397,360 | A | | 8/1983 | Schmidt |
| 4,401,171 | A | | 8/1983 | Fuchs |
| 4,402,551 | A | | 9/1983 | Wood et al. |
| 4,407,376 | A | | 10/1983 | Inoue |
| 4,415,205 | A | | 11/1983 | Rehm et al. |
| 4,437,706 | A | | 3/1984 | Johnson |
| 4,442,476 | A | | 4/1984 | Lenderking et al. |
| 4,442,896 | A | | 4/1984 | Reale et al. |
| 4,494,616 | A | | 1/1985 | McKee |
| 4,512,422 | A | | 4/1985 | Knisley |
| 4,519,463 | A | | 5/1985 | Schuh |
| 4,527,639 | A | | 7/1985 | Dickinson, III et al. |
| 4,532,986 | A | | 8/1985 | Mims et al. |
| 4,544,037 | A | | 10/1985 | Terry |
| 4,558,744 | A | | 12/1985 | Gibb |
| 4,565,252 | A | | 1/1986 | Campbell et al. |
| 4,573,541 | A | | 3/1986 | Josse et al. |
| 4,599,172 | A | | 7/1986 | Gardes |
| 4,600,061 | A | | 7/1986 | Richards |
| 4,605,076 | A | | 8/1986 | Goodhart |
| 4,611,855 | A | | 9/1986 | Richards |
| 4,618,009 | A | | 10/1986 | Carter et al. |
| 4,638,949 | A | | 1/1987 | Mancel |
| 4,646,836 | A | | 3/1987 | Goodhart |
| 4,674,579 | A | | 6/1987 | Geller et al. |
| 4,693,327 | A | | 9/1987 | Dickinson et al. |
| 4,699,224 | A | | 10/1987 | Burton |
| 4,702,314 | A | | 10/1987 | Huang et al. |
| 4,705,431 | A | | 11/1987 | Gadelle et al. |
| 4,715,440 | A | | 12/1987 | Boxell et al. |
| 4,754,819 | A | | 7/1988 | Dellinger |
| 4,756,367 | A | | 7/1988 | Puri et al. |
| 4,763,734 | A | | 8/1988 | Dickinson et al. |
| 4,773,488 | A | | 9/1988 | Bell et al. |
| 4,807,704 | A | | 2/1989 | Hsu et al. |
| 4,830,105 | A | | 5/1989 | Petermann |
| 4,836,611 | A | | 6/1989 | El-Saie |
| 4,842,081 | A | | 6/1989 | Parant |
| 4,844,182 | A | | 7/1989 | Tolle |
| 4,852,666 | A | | 8/1989 | Brunet et al. |
| 4,883,122 | A | | 11/1989 | Puri et al. |
| 4,978,172 | A | | 12/1990 | Schwoebel et al. |
| 5,012,877 | A | | 5/1991 | Winters et al. |
| 5,016,710 | A | | 5/1991 | Renard et al. |
| 5,035,605 | A | | 7/1991 | Dinerman et al. |
| 5,036,921 | A | | 8/1991 | Pittard et al. |
| 5,074,360 | A | | 12/1991 | Guinn |
| 5,074,365 | A | | 12/1991 | Kuckes |
| 5,074,366 | A | | 12/1991 | Karlsson et al. |
| 5,082,054 | A | | 1/1992 | Kiamanesh |
| 5,111,893 | A | | 5/1992 | Kvello-Aune |
| 5,115,872 | A | | 5/1992 | Brunet et al. |
| 5,135,058 | A | | 8/1992 | Millgard et al. |
| 5,148,875 | A | | 9/1992 | Karlsson et al. |
| 5,165,491 | A | | 11/1992 | Wilson |
| 5,168,942 | A | | 12/1992 | Wydrinski |
| 5,174,374 | A | | 12/1992 | Hailey |
| 5,193,620 | A | | 3/1993 | Braddick |
| 5,194,859 | A | | 3/1993 | Warren |
| 5,197,553 | A | | 3/1993 | Leturno |
| 5,197,783 | A | | 3/1993 | Theimer et al. |
| 5,199,496 | A | | 4/1993 | Redus et al. |
| 5,201,817 | A | | 4/1993 | Hailey |
| 5,217,076 | A | | 6/1993 | Masek |
| 5,226,495 | A | | 7/1993 | Jennings, Jr. |
| 5,240,350 | A | | 8/1993 | Yamaguchi et al. |
| 5,242,017 | A | | 9/1993 | Hailey |
| 5,242,025 | A | | 9/1993 | Neill et al. |
| 5,246,273 | A | | 9/1993 | Rosar |
| 5,255,741 | A | | 10/1993 | Alexander |
| 5,271,472 | A | | 12/1993 | Leturno |
| 5,301,760 | A | | 4/1994 | Graham |
| 5,311,936 | A | | 5/1994 | McNair et al. |
| 5,318,121 | A | | 6/1994 | Brockman et al. |
| 5,318,122 | A | | 6/1994 | Murray et al. |
| 5,322,127 | A | | 6/1994 | McNair et al. |
| 5,325,924 | A | | 7/1994 | Bangert et al. |
| 5,353,876 | A | | 10/1994 | Curington et al. |
| 5,363,927 | A | | 11/1994 | Frank |
| 5,385,205 | A | | 1/1995 | Hailey |
| 5,388,648 | A | | 2/1995 | Jordan, Jr. |
| 5,394,950 | A | | 3/1995 | Gardes |
| 5,402,851 | A | | 4/1995 | Baiton |

5,411,082 A 5/1995 Kennedy
5,411,085 A 5/1995 Moore et al.
5,411,088 A 5/1995 LeBlanc et al.
5,411,104 A 5/1995 Stanley
5,411,105 A 5/1995 Gray
5,431,220 A 7/1995 Lennon et al.
5,431,223 A 7/1995 Konopczynski
5,435,400 A 7/1995 Smith
5,439,051 A 8/1995 Kennedy et al.
5,447,416 A 9/1995 Wittrisch
5,450,902 A 9/1995 Matthews
5,454,419 A 10/1995 Vloedman
5,458,209 A 10/1995 Hayes et al.
5,462,116 A 10/1995 Carroll
5,462,120 A 10/1995 Gondouin
5,469,155 A 11/1995 Archambeault et al.
5,474,131 A 12/1995 Jordan, Jr. et al.
5,477,923 A 12/1995 Jordan, Jr. et al.
5,477,925 A 12/1995 Trahan et al.
5,485,089 A 1/1996 Kuckes
5,494,121 A 2/1996 Nackerud
5,499,687 A 3/1996 Lee
5,501,273 A 3/1996 Puri
5,501,279 A 3/1996 Garg et al.
5,520,252 A 5/1996 McNair
5,584,605 A 12/1996 Beard et al.
5,613,242 A 3/1997 Oddo
5,615,739 A 4/1997 Dallas
5,653,286 A 8/1997 McCoy et al.
5,669,444 A 9/1997 Riese et al.
5,680,901 A 10/1997 Gardes
5,690,390 A 11/1997 Bithell
5,706,871 A 1/1998 Andersson et al.
5,720,356 A 2/1998 Gardes
5,727,629 A 3/1998 Blizzard, Jr. et al.
5,735,350 A 4/1998 Longbottom et al.
5,771,976 A 6/1998 Talley
5,775,433 A 7/1998 Hammett et al.
5,785,133 A 7/1998 Murray et al.
5,832,958 A 11/1998 Cheng
5,853,054 A 12/1998 McGarian et al.
5,853,056 A 12/1998 Landers
5,853,224 A 12/1998 Riese
5,863,283 A 1/1999 Gardes
5,868,202 A 2/1999 Hsu
5,868,210 A 2/1999 Johnson et al.
5,879,057 A 3/1999 Schwoebel et al.
5,884,698 A 3/1999 Hughes et al.
5,884,704 A 3/1999 Longbottom et al.
5,917,325 A 6/1999 Smith
5,934,390 A 8/1999 Uthe
5,938,004 A 8/1999 Roberts et al.
5,941,308 A 8/1999 Malone et al.
5,944,108 A 8/1999 Baugh et al.
5,957,539 A 9/1999 Durup et al.
5,971,074 A 10/1999 Longbottom et al.
5,992,524 A 11/1999 Graham
6,012,516 A 1/2000 Brunet
6,012,520 A 1/2000 Yu et al.
6,012,526 A 1/2000 Jennings et al.
6,015,012 A 1/2000 Reddick
6,024,171 A 2/2000 Montgomery et al.
6,047,774 A 4/2000 Allen
6,050,335 A 4/2000 Parsons
6,053,254 A 4/2000 Gano
6,056,059 A 5/2000 Ohmer
6,065,209 A 5/2000 Gondouin
6,065,550 A 5/2000 Gardes
6,070,671 A 6/2000 Cumming et al.
6,079,488 A 6/2000 Begg et al.
6,089,320 A 7/2000 LaGrange
6,119,771 A 9/2000 Gano et al.
6,135,208 A 10/2000 Gano et al.
6,145,593 A 11/2000 Hennig
6,170,573 B1 1/2001 Brunet et al.
6,179,054 B1 1/2001 Stewart
6,186,233 B1 2/2001 Brunet
6,199,633 B1 3/2001 Longbottom
6,199,635 B1 3/2001 Brunet et al.
6,209,636 B1 4/2001 Roberts et al.
6,209,644 B1 4/2001 Brunet
6,209,648 B1 4/2001 Ohmer et al.
6,244,337 B1 6/2001 Cumming et al.
6,253,846 B1 7/2001 Nazzai et al.
6,263,968 B1 7/2001 Freeman et al.
6,279,659 B1 8/2001 Brunet
6,280,000 B1 8/2001 Zupanick
6,283,216 B1 9/2001 Ohmer
6,315,054 B1 11/2001 Brunet
6,349,769 B1 2/2002 Ohmer
6,357,523 B1 3/2002 Zupanick
6,357,530 B1 3/2002 Kennedy et al.
6,419,026 B1 7/2002 MacKenzie et al.
6,425,448 B1 7/2002 Zupanick et al.
6,439,320 B2 8/2002 Zupanick
6,450,256 B2 9/2002 Mones
6,454,000 B1 9/2002 Zupanick
6,457,525 B1 10/2002 Scott
6,457,540 B2 10/2002 Gardes
6,464,001 B1 10/2002 Braithwaite et al.
6,478,085 B2 11/2002 Zupanick
6,497,556 B2 12/2002 Zupanick et al.
6,536,531 B2 3/2003 Brunet
6,543,552 B1 4/2003 Metcalfe et al.
6,547,006 B1 4/2003 Kuck et al.
6,561,277 B2 5/2003 Algeroy et al.
6,561,279 B2 5/2003 MacKenzie et al.
6,561,288 B2 5/2003 Zupanick
6,566,649 B1 5/2003 Mickael
6,568,469 B2 5/2003 Ohmer et al.
6,571,888 B2 6/2003 Comeau et al.
6,575,235 B2 6/2003 Zupanick et al.
6,577,129 B1 6/2003 Thompson et al.
6,585,061 B2 7/2003 Radzinski et al.
6,590,202 B2 7/2003 Mickael
6,591,903 B2 7/2003 Ingle et al.
6,598,686 B1 7/2003 Zupanick
6,604,580 B2 8/2003 Zupanick et al.
6,604,910 B1 8/2003 Zupanick
6,607,042 B2 8/2003 Hoyer et al.
6,622,792 B1 9/2003 Schick
6,636,159 B1 10/2003 Winnacker
6,639,210 B2 10/2003 Odom et al.
6,646,441 B2 11/2003 Thompson et al.
6,653,839 B2 11/2003 Yuratich et al.
6,662,870 B1 12/2003 Zupanick et al.
6,668,918 B2 12/2003 Zupanick
6,679,322 B1 1/2004 Zupanick
6,681,855 B2 1/2004 Zupanick et al.
6,688,388 B2 2/2004 Zupanick
6,708,764 B2 3/2004 Zupanick
6,725,922 B2 4/2004 Zupanick
6,732,792 B2 5/2004 Zupanick
6,732,801 B2 5/2004 Ohmer et al.
6,745,855 B2 6/2004 Gardes
6,752,211 B2 6/2004 Dewey et al.
6,758,289 B2 7/2004 Kelley et al.
6,766,859 B2 7/2004 Haugen et al.
6,786,282 B2 9/2004 Begg et al.
6,848,504 B2 2/2005 Brunet et al.
6,923,275 B2 8/2005 Gardes
2002/0000319 A1 1/2002 Brunet
2002/0023747 A1 2/2002 Begg
2002/0070018 A1 6/2002 Buyaert
2002/0096336 A1 7/2002 Zupanick et al.
2002/0100588 A1 8/2002 Murray et al.

| | | | |
|---|---|---|---|
| 2002/0157826 | A1 | 10/2002 | MacKenzie et al. |
| 2002/0189801 | A1 | 12/2002 | Zupanick et al. |
| 2003/0066686 | A1 | 4/2003 | Conn |
| 2003/0075334 | A1 | 4/2003 | Haugen et al. |
| 2003/0217842 | A1 | 11/2003 | Zupanick et al. |
| 2004/0007389 | A1 | 1/2004 | Zupanick |
| 2004/0007390 | A1 | 1/2004 | Zupanick |
| 2004/0011529 | A1 | 1/2004 | McGarian et al. |
| 2004/0031609 | A1 | 2/2004 | Zupanick |
| 2004/0035581 | A1 | 2/2004 | Cavender |
| 2004/0035582 | A1 | 2/2004 | Zupanick |
| 2004/0050552 | A1 | 3/2004 | Zupanick |
| 2004/0050554 | A1 | 3/2004 | Zupanick et al. |
| 2004/0055787 | A1 | 3/2004 | Zupanick |
| 2004/0092404 | A1 | 5/2004 | Murray et al. |
| 2004/0108110 | A1 | 6/2004 | Zupanick |
| 2004/0118558 | A1 | 6/2004 | Rial et al. |
| 2004/0149432 | A1 | 8/2004 | Zupanick |
| 2004/0154802 | A1 | 8/2004 | Zupanick |
| 2004/0159435 | A1 | 8/2004 | Plucheck et al. |
| 2004/0159436 | A1 | 8/2004 | Zupanick |
| 2004/0244974 | A1 | 12/2004 | Zupanick et al. |
| 2004/0244992 | A1 | 12/2004 | Carter et al. |
| 2005/0006100 | A1 | 1/2005 | Murray et al. |
| 2005/0039915 | A1 | 2/2005 | Murray |
| 2005/0087340 | A1 | 4/2005 | Zupanick et al. |
| 2005/0103490 | A1 | 5/2005 | Pauley |
| 2005/0115709 | A1 | 6/2005 | Zupanick et al. |
| 2005/0241826 | A1 | 11/2005 | Pratt |

FOREIGN PATENT DOCUMENTS

| | | | |
|---|---|---|---|
| CH | 653 741 | | 1/1986 |
| DE | 3 832 715 | | 3/1990 |
| EP | 0 875 661 | A1 | 11/1998 |
| EP | 0 952 300 | A1 | 10/1999 |
| EP | 1 249 574 | A2 | 10/2002 |
| EP | 1 133 617 | B1 | 9/2004 |
| FR | 964503 | | 8/1950 |
| GB | 2 255 033 | | 10/1992 |
| GB | 2 297 988 | | 8/1996 |
| GB | 2 318 817 | | 5/1998 |
| GB | 2 345 933 | | 7/2000 |
| GB | 2 347 157 | | 8/2000 |
| GB | 2 381 809 | | 5/2003 |
| SU | 750108 | | 6/1975 |
| SU | 1448078 | A1 | 3/1987 |
| SU | 1770570 | A1 | 3/1990 |
| WO | WO 94/21889 | | 9/1994 |
| WO | WO 98/09053 | | 3/1998 |
| WO | WO 98/35133 | | 8/1998 |
| WO | WO 99/60248 | | 11/1999 |
| WO | WO 00/31376 | | 6/2000 |
| WO | WO 00/79099 | A1 | 12/2000 |
| WO | WO 01/44620 | | 6/2001 |
| WO | WO 01/90533 | A1 | 11/2001 |
| WO | WO 02/18738 | A1 | 3/2002 |
| WO | WO 02/059455 | A1 | 8/2002 |
| WO | WO 02/061238 | A1 | 8/2002 |
| WO | WO 03/102348 | A2 | 12/2003 |

OTHER PUBLICATIONS

Berger, Bill, et al., "*Modern Petroleum: A Basic Primer of the Industry*," PennWell Books, 1978, Title Page, Copyright Page, and pp. 106-108 (5 pages).

Jones, Arfon H., et al., "*A Review of the Physical and Mechanical Properties of Coal with Implications for Coal-Bed Methane Well Completion and Production*," Rocky Mountain Association of Geologists, 1988, pp. 169-181 (13 pages).

Hartman, Howard L., et al., "*SME Mining Engineering Handbook*;" Society for Mining, Metallurgy, and Exploration, Inc., 2nd Edition, vol. 2, 1992, Title Page, pp. 1946-1950 (6 pages).

Hassan, Dave, et al., "*Multi-Lateral Technique Lowers Drilling Costs, Provides Environmental Benefits*," Drilling Technology, Oct. 1999, pp. 41-47 (7 pages).

Ramaswamy, Gopal, "*Production History Provides CBM Insights*," Oil & Gas Journal, Apr. 2, 2001, pp. 49-50 and 52 (3 pages).

Chi, Weiguo, et al., "*Feasibility of Coalbed Methane Exploitation in China*," Horizontal Well Technology, Sep. 2001, Title Page and p. 74 (2 pages).

Nackerud Product Description, Harvest Tool Company, LLC, Received Sep. 27, 2001, 1 page.

Ramaswamy, Gopal, "*Advances Key For Coalbed Methane*," The American Oil & Gas Reporter, Oct. 2001, Title Page and pp. 71 and 73 (3 pages).

Stevens, Joseph C., "*Horizontal Applications for Coal Bed Methane Recovery*," Strategic Research Institute, 3rd Annual Coalbed and Coal Mine Methane Conferences, Slides, Mar. 25, 2002, Title Page, Introduction Page and pp. 1-10 (13 pages).

Stayton, R.J. "Bob", "*Horizontal Wells Boost CBM Recovery*," Special Report: Horizontal and Directional Drilling, The American Oil and Gas Reporter, Aug. 2002, pp. 71, 73-75 (4 pages).

Eaton, Susan, "*Reversal of Fortune: Vertical and Horizontal Well Hybrid Offers Longer Field Life*," New Technology Magazine, Sep. 2002, pp. 30-31 (2 pages).

Mahony, James, "*A Shadow of Things to Come*," New Technology Magazine, Sep. 2002, pp. 28-29 (2 pages).

Documents Received from Third Party, Great Lakes Directional Drilling, Inc., Sep. 12, 2002, (12 pages).

Taylor, Robert W., et al. "*Multilateral Technologies Increase Operational Efficiencies in Middle East*," Oil and Gas Journal, Mar. 16, 1998, pp. 76-80 (5 pages).

Pasiczynk, Adam, "*Evolution Simplifies Multilateral Wells*," Directional Drilling, Jun. 2000, pp. 53-55 (3 pages).

Bell, Steven S. "*Multilateral System with Full Re-Entry Access Installed*," World Oil, Jun. 1, 1996, p. 29 (1 page).

Jackson, P., et al., "*Reducing Long Term Methane Emissions Resulting from Coal Mining*," Energy Convers. Mgmt, vol. 37, Nos. 6-8, 1996, pp. 801-806, (6 pages).

Breant, Pascal, "*Des Puits Branches, Chez Total : les puits multi drains*," Total XP-000846928, Exploration Production, Jan. 1999, 11 pages, including translation.

Chi, Weiguo, "*A feasible discussion on exploitation coalbed methane through Horizontal Network Drilling in China*," SPE 64709, Society of Petroleum Engineers (SPE International), Nov. 7, 2000, 4 pages.

B. Goktas et al., "*Performances of Openhole Completed and Cased Horizontal/Undulating Wells in Thin-Bedded, Tight Sand Gas Reservoirs*," SPE 65619, Society of Petroleum Engineers, Oct. 17-19, 2000, (7 pages).

Sharma, R., et al., "*Modelling of Undulating Wellbore Trajectories*," The Journal of Canadian Petroleum Technology, vol. 34, No. 10, XP-002261908, Oct. 18-20, 1993 pp. 16-24 (9 pages).

Balbinski, E.F., "*Prediction of Offshore Viscous Oil Field Performance*," European Symposium on Improved Oil Recovery, Aug. 18-20, 1999, 10 pages.

Notification of Transmittal of the International Search Report or the Declaration (PCT Rule 44.1)(3 pages) and International Search Report (4 pages) re International Application No. PCT/US 03/21626 mailed Nov. 6, 2003.

Notification of Transmittal of the International Search Report or the Declaration (PCT Rule 44.1)(3 pages) and International Search Report (5 pages) re International Application No. PCT/US 03/21627 mailed Nov. 5, 2003.

Notification of Transmittal of the International Search Report or the Declaration (PCT Rule 44.1)(3 pages) and International Search Report (4 pages) re International Application No. PCT/US 03/21628 mailed Nov. 4, 2003.

Notification of Transmittal of the International Search Report or the Declaration (PCT Rule 44.1)(3 pages) and International Search Report (5 pages) re International Application No. PCT/US 03/21750 mailed Dec. 5, 2003.

Notification of Transmittal of the International Search Report or the Declaration (PCT Rule 44.1)(3 pages) and International Search Report (3 pages) re International Application No. PCT/US 03/28137 mailed Dec. 19, 2003.
Notification of Transmittal of the International Search Report or the Declaration (PCT Rule 44.1)(3 pages) and International Search Report (5 pages) re International Application No. PCT/US 03/26124 mailed Feb. 4, 2004.
Notification of Transmittal of the International Search Report or the Declaration (PCT Rule 44.1)(3 pages) and International Search Report (6 pages) re International Application No. PCT/US 03/28138 mailed Feb. 9, 2004.
Notification of Transmittal of the International Search Report or the Declaration (PCT Rule 44.1)(3 pages) and International Search Report (6 pages) re International Application No. PCT/US-03/30126 mailed Feb. 27, 2004.
Smith, Maurice, "*Chasing Unconventional Gas Unconventionally*," CBM Gas Technology, New Technology Magazine, Oct./Nov. 2003, Title Page and pp. 1-4 (5 pages).
Gardes, Robert, "*A New Direction in Coalbed Methane and Shale Gas Recovery*," (to the best of Applicants' recollection, first received at The Canadian Institute Coalbed Methane Symposium conference on Jun. 16 and Jun. 17, 2002), 7 pages.
Gardes, Robert, "*Under-Balanced Multi-Lateral Drilling for Unconventional Gas Recovery*," (to the best of Applicants' recollection, first received at The Unconventional Gas Revolution conference on Dec. 9, 2003, 30 pages.
Boyce, Richard G., "*High Resolution Selsmic Imaging Programs for Coalbed Methane Development*," (to the best of Applicants' recollection, first received at The Unconventional Gas Revolution conference on Dec. 10, 2003), 29 pages.
Mazzella, Mark, et al., "*Well Control Operations on a Multiwell Platform Blowout*," WorldOil.com—Online Magazine Article, vol. 22, Part 1—pp. 1-7, Jan. 2001, and Part II, Feb. 2001, pp. 1-13 (20 pages).
Vector Magnetics, LLC, Case History, California, May 1999, "*Successful Kill of a Surface Blowout*," 1999, pp. 1-12.
Cudd Pressure Control, Inc, "*Successful Well Control Operations—A Case Study: Surface and Subsurface Well Intervention on a Multi-Well Offshore Platform Blowout and Fire," 2000, pp. 1-17, http://www.cuddwellcontrol.com/literature/successful/successful*_well.htm.
Purl, R., et al., "*Damage to Coal Permeability During Hydraulic Fracturing*," SPE 21813, 1991, Title Page and pp. 109-115 (8 pages).
U.S. Dept. of Energy—Office of Fossil Energy, "*Multi-Seam Well Completion Technology: Implications for Powder River Basin Coalbed Methane Production*," Sep. 2003, pp. 1-100, A-1 through A-10 (123 pages).
U.S. Dept of Energy—Office of Fossil Energy, "*Powder River Basin Coalbed Methane Development and Produced Water Management Study*," Nov. 2002, pp. 1-111, A-1 through A-14 (213 pages).
Fletcher, Sam, "*Anadarko Cuts Route Under Canadian River Gorge*," Oil & Gas Journal, Jan. 5, 2004, pp. 28-30, (3 pages).
Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores*," Moscow, Nedra Publishers, 1997, 15 pages.
Arens, V. Zh., Translation of Selected Pages, "*Well-Drilling Recovery of Minerals*," Moscow, Nedra Publishers, 1986, 7 pages.
Zupanick , U.S. Patent Application entitled "Slant Entry Well System and Method," U.S. Appl. No. 10/004,316, Oct. 30, 2001 (WO 03/038233) (36 pages).
Diamond et al., U.S. Patent Application entitled "Method and System for Removing Fluid From a Subterranean Zone Using an Enlarged Cavity," U.S. Appl. No. 10/264,535, Oct. 3, 2002 (37 pages).
Zupanick, U.S. Patent Application entitled "Method of Drilling Lateral Wellbores From a Slant Well Without Utilizing a Whipstock," U.S. Appl. No. 10/267,426, Oct. 8, 2002 (24 pages).
Seams, Douglas, U.S. Patent Application entitled "Method and System for Extraction of Resources from a Subterranean Well Bore," U.S. Appl. No. 10/723,322, Nov. 26, 2003 (40 pages).
Zupanick, U.S. Patent Application entitled "Method and System for Testing A Partially Formed Hydrocarbon Well for Evaluation and Well Planning Refinement," U.S. Appl. No. 10/769,221, Jan. 30, 2004 (34 pages).
Palmer, Ian D., et al., "*Coalbed Methane Well Completions and Stimulations*," Chapter 14, Hydrocarbons From Coal, American Association of Petroleum Geologists, 1993, pp. 303-339.
Praful Desai, "*Innovative Design Allows Construction of Level 3 or Level 4 Junction Using the Same Platform*," © 2002, SPE/PS-CIM/CHOA International Thermal Operations and Heavy Oil Symposium and International Horizontal Well Technology Conference, held Nov. 4-7, 2002 in Calgary, Alberta, Canada, 11 pages.
Karen Bybee, "*A New Generation Multilateral System for the Troll Oije Field*," presented originally at the 2001 SPE Offshore Europe, Aberdeen, Sep. 4-7, 2001, pp. 50-51.
Karen Bybee, "*Advanced Openhole Multilaterals*," presented at the 2002 IADC/SPE Asia Pacific Drilling Technology, Kakarta, Sep. 9-11, 2002, pp. 41-42.
Emerson, et al., "*Moving Toward Simpler, Highly Functional Multilateral Completions*," JCPT, May 2002, vol. 41, No. 5, p. 9-12 (4 pages).
Guntis Moritis, "*Complex Well Geometries Boost Orinoco Heavy Oil Producing Rates*," Oil & Gas Journal, Feb. 28, 2000, pp. 42-46.
Themig, Dan, "*Multilateral Thinking*," New Technology Magazine, Dec. 1999, pp. 24-25.
R.C. Smith, et al., "*The Lateral Tie-Back System: The Ability to Drill and Case*," presented at the 1994 IADC/SPE Drilling Conference held in Dallas, Texas, Feb. 15-18, 1994, pp. 55-66.
Fipke, S., et al., "*Economical Multilateral Well Technology for Canadian Heavy Oil*," Petroleum Society, Canadian Institute of Mining, Metallurgy & Petroleum, Paper 2002-100, to be presented in Calgary Alberta, Jun. 11-13, 2002, pp. 1-11.
Oilfield Review, "Constructing Wellbore Junctions," Website: http://www.oilfield.slb.com/media/external/ori__2004q2/001__constructing.html, printed Mar. 8, 2005 (1 page).
Oilfield Review—Junction Classifications—PRINT, "Oilfield Review Interactive Multilateral Technology," Website: http://www.oilfield.slb.com/media/external/ori__2004q2/print/001b JC__print.html, printed Mar. 8, 2005 (2 pages).
World Oil, "Evolution Toward Simpler, Less Risky Multilateral Wells—Statistical Data Included," Website: http://www.findarticles.com/p/articles/mi__m3159/is__6__222/ai__75918331/print, printed Feb. 24, 2005, copyright 2001 (7 pages).
World Oil, "Operators Take Advantage of Recent Innovations—Technology at Work—Oil Exploration Services Technology—Brief Article," Website: http://www.findarticles.com/p/articles/mi__m3159/is__2__223/ai__83669000/print, printed Feb. 24, 2005, copyright 2002 (10 pages).
Dick Ghiselin, "November: Production Optimization: Technology Scene at Offshore Europe," Hart's E&P Net, Website: http://www.eandpnet.com/ep/previous/1103/1103prod__optimization .htm, printed Feb. 24, 2005, Nov. 2003 (3 pages).
Dennis Denney, Highlights of paper SPE 87207, "Multilateral Wells Improve Development in Heavy Oil Field," Website: http://www.spe.org/spe/ipt/isp/iptpaperssynopsis/0.2439.1104__11038__2557364__2585012,0 . . . , printed Feb. 24, 2005, JPT Online, Jul. 2004 (4 pages).
Baker Hughes, "Multilateral Case History—Rotterdam 19, Level 4, The Netherlands," copyright 1999 (1 page).
Solutions From the Field, "Horizontal Drilling Helps Recovery Rates," Petroleum Technology Transfer Counsel, Website: http://www.pttc.org/solutions/20.htm, printed Feb. 24, 2005, copyright 2004 (4 pages).
Baker Oil Tools, "Multilaterals," Website: http://www.bakerhughes.com/bot/multilateral/index.htm, printed Mar. 8, 2005, copyright 2005 (2 pages).
Baker Oil Tools, "Liner Hangers," Website: http://www.bakerhughes.com/bot/liner__hangers/index.htm, printed Mar. 8, 2005, copyright 2005 (1 page).
Baker Hughes Geothermal, "Multilateral Technology," and Subpages from Website: http://www.bakerhughes.com/bakerhughes/geothermal/multilateral__tech.htm, printed Mar. 8, 2005, copyright 2005 (7 pages).

William P. Diamond, "Methane Control for Underground Coal Mines," IC-9395, Bureau of Mines Information Circular, United States Department of the Interior, 1994 (51 pages).
David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982, 56 pages.
Notification of Transmittal of the International Search Report and the Written Opinion of the International Searching Authority, or the Declaration (3 pages), International Search Report (6 pages), and Written Opinion of the International Searching Authority (5 pages) for International Application No. PCT/US2005/003354 mailed Apr. 20, 2005.
Pratt, U.S. Patent Application entitled, "Method and System for Lining Multilateral Wells," U.S. Appl. No. 10/772,841, filed Feb. 5, 2004 (30 pages).
Pratt et al., U.S. Patent Application entitled, "Lining Well Bore Junctions," U.S. Appl. No. 11/020,374, filed Dec. 22, 2004 (42 pages).
Notification of Transmittal of the International Search Report and the Written Opinion of the International Searching Authority, or the Declaration (2 pages), International Search Report (5 pages), and Written Opinion of the International Searching Authority (7 pages) for International Application No. PCT/US2005/046986 mailed Apr. 24, 2006.
E.J. Antczak, et al., "*Implementation of an Advanced Multi-Lateral System With Coiled Tubing Accessibility*," SPE/IADC 37673, Society of Petroleum Engineers, Copyright 1997, 9 pages.
Search report for PCT application serial No. PCT/US2005/046986 mailed Apr. 24, 2006.
Notification Concerning Transmittal of Copy of International Preliminary Report on Patentability (Chapter I of the Patent Cooperation Treaty) (1 page), International Preliminary Report on Patentability (1 page), and Written Opinion of the International Searching Authority (4 pages) for International Application No. PCT/US2005/003354 mailed Aug. 17, 2006.

* cited by examiner

ADJUSTABLE WINDOW LINER

The present application incorporates by reference the following concurrently filed U.S. patent application entitled Lining Well Bore Junctions, listing Christopher A. Pratt and Bruno H. Walter as inventors and attorney docket number 17601-108001.

TECHNICAL FIELD

The present invention relates in general to lining well bores, and more particularly to lining a junction between two well bores.

BACKGROUND

Well bores are lined with tubing, referred to as a casing or a liner, for many reasons, for example, to prevent formation collapse into the bore, protect fresh-water formations, isolate a zone of lost returns or isolate formations with significantly different pressure gradients. The tubing is usually manufactured from plain carbon steel that is heat-treated to varying strengths, but may be specially fabricated of stainless steel, aluminum, titanium, fiberglass and other materials. A single liner may extend from the top of the well bore or one liner may be anchored or suspended from inside the bottom of the previous strings of liner.

Lining a well that includes one or more auxiliary bores extending from a main bore is difficult, because a junction must be made between the liner for the auxiliary bore and the liner for the main bore. The liner spanning the junction is installed through the liner in the main bore, and must be oriented with respect to the bores and make a connection downhole. Furthermore, the auxiliary bore is often drilled through the main bore with the liner of the main bore installed. The drilling bit is deflected into the wall of the main bore with a whipstock. Therefore, numerous trips into and out of the well are required to set the whipstock, drill the auxiliary bore, and set the liner in the auxiliary bore. For example, in the past, lining a well with laterals has required one trip (into and out) to set whipstock in the main bore liner, one trip to drill the auxiliary bore, one trip to set the auxiliary bore liner, and one trip to withdraw or reposition the whipstock for drilling and lining additional auxiliary bores. Trips into and out of the well are time consuming and add to the expense of completing a well, as well as delay the time in which the well begins to produce.

SUMMARY

The present disclosure is drawn to systems and methods for lining a junction between two well bores.

One illustrative implementation encompasses a method of positioning a well bore liner in a well. According to the method, the well bore liner is received in a main bore of the well carried on a working string. The well bore liner is directed from the main bore into an auxiliary bore of the well with a whipstock. The whipstock and the working string are coupled without withdrawing the working string from the main bore. The whipstock is then relocated using the working string.

Another illustrative implementation encompasses a system for lining a junction between a main bore and an auxiliary bore. The system includes a first tubing adapted to line at least a portion of the main bore. The first tubing has a lateral opening therein. A second tubing has a junction shield flange extending outward therefrom. The junction shield flange is adapted to at least partially span a gap between the second tubing and an edge of the lateral opening when the second tubing resides in the auxiliary bore. A cover is provide for the lateral opening. The cover is changeable between a closed position covering more of the lateral opening than is covered in an open position.

Another illustrative implementation encompasses a device for depositing a well bore liner into a well. The device is adapted to carry the well bore liner in the well and to deposit the well bore liner in the well. The device is also adapted to carry the whipstock in the well and thereafter release the whipstock.

Yet another illustrative implementation encompasses a system for lining a junction between a main bore and an auxiliary bore. In the system, a first tubing is adapted to line at least a portion of the main bore. The first tubing has a lateral opening therein. A second tubing has a junction shield extending outward therefrom. The junction shield has a larger transverse dimension than the lateral opening. The junction shield is adapted to contract to a smaller transverse dimension to pass through the lateral opening into the auxiliary bore.

An advantage of some implementations is that the liner that spans between a liner in the auxiliary bore and a liner in the main bore, referred to as the junction liner, can be constructed to loosely connect with the liner in the main bore. As a result, the junction liner is inexpensive to construct. For example, one illustrative junction liner described herein includes no moving or high precision parts that would require complex and expensive machining to construct. Furthermore, because the fit between the junction liner and main liner can be imprecise, installation of the junction liner is a relatively quick and easy operation. When configured to provide a loose fit between the junction liner and main liner, the liner system is suited for installation in a coal seam where the material of the seam breaks-up or disassociates from the formation in larger particles. As the liners, including the junction liner, will be left in the well, a reduced cost junction liner reduces the overall cost of the well.

An advantage of some implementations is that the liners can be used in lining small bores. For example, one illustrative junction liner described herein has few complex or moving parts. Accordingly, the illustrative junction liner can be compact to pass through small tubulars. Some implementations can be used in lining a main bore with 5-½ inch tubing and lining an auxiliary bore with 2-⅞ inch tubing.

An advantage of some implementations is that the number of trips into and out of the well bore during positioning the liners in the well can be reduced. For example, by providing a junction running tool that combines functionality of carrying the junction liner and engaging and actuating the whipstock, the junction running tool need not be withdrawn from the well bore to manipulate the whipstock.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
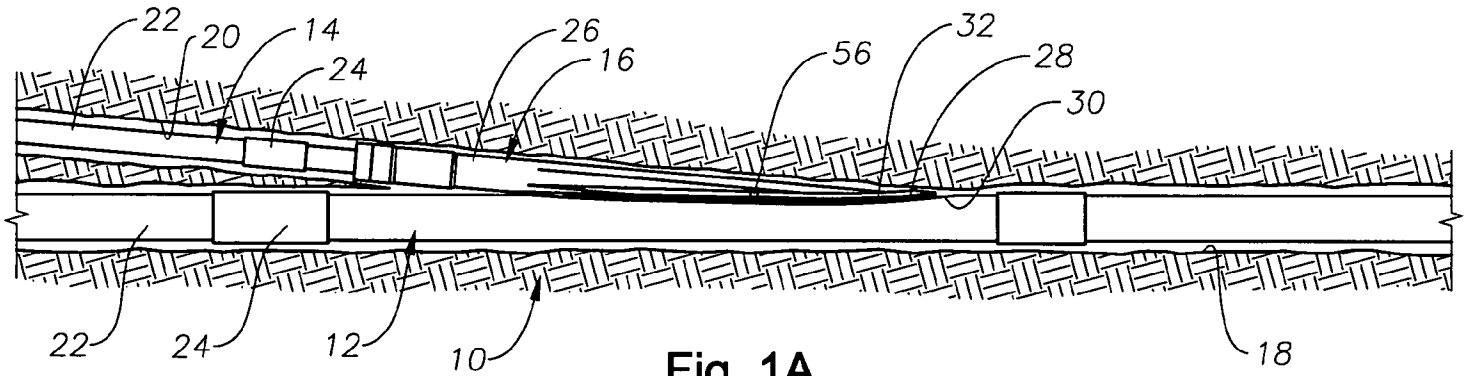
FIG. 1A is a cross-sectional view of an illustrative liner system constructed in accordance with the invention.
Figure 1B:
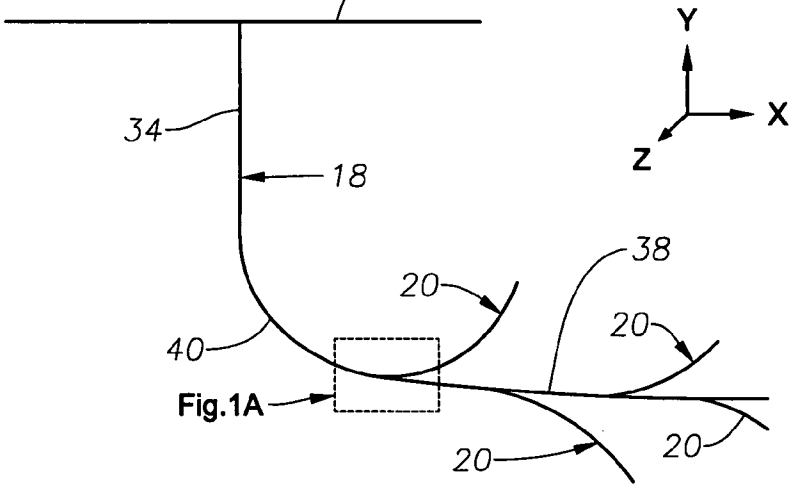
FIG. 1B is a cross-sectional view of an illustrative articulated main well bore having horizontal, lateral auxiliary bores and incorporating the liner system of FIG. 1A.

Referring first to FIG. 1A, an illustrative liner system 10 constructed in accordance with the invention includes a main liner 12, an auxiliary liner 14, and a junction liner 16. The main liner 12 is adapted for receipt in a main well bore 18 of a subterranean well, the auxiliary liner 14 is adapted for receipt in an auxiliary well bore 20 of the subterranean well, and the junction liner 16 is adapted to span between the main liner 12 and auxiliary liner 14. The main well bore 18 and auxiliary well bore 20 can be configured in any number of configurations, and the number of auxiliary well bores 20 coupled to the main well bore 18 can vary. For example, FIG. 1B depicts a multilateral well configuration where the main well bore 18 is an articulated well bore having a first portion 34 that extends from the surface 36, a second portion 38 deviating from the first portion 34 and a curved portion 40 between the first portion 34 and the second portion 38. The second portion 38 may be horizontal or may extend at an acute angle in relation to the first portion 34, for example to track an up dip or down dip subterranean zone (ex. a coal seam). The auxiliary well bores 20 may be lateral well bores extending from the second portion 38. In the implementation of FIG. 1B, the junction liner 16 is positioned at a junction between a lateral auxiliary well bore 20 and the second portion 38 of the main well bore 18. Similarly, the junction liner 16 may be positioned at the junction between additional lateral auxiliary well bores 20 and the second portion 38 of the main well bore 18. In such an implementation, the main liner 12 may accommodate the additional junctions by providing a corresponding number of additional lateral openings 30.

Figure 1C:
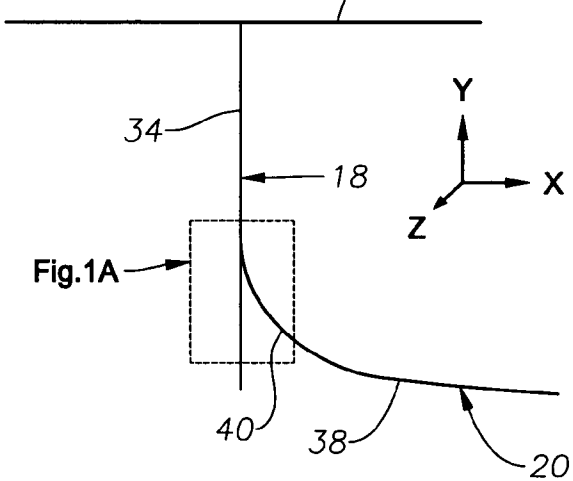
FIG. 1C is a cross-sectional view of an illustrative vertical main well bore and articulated auxiliary well bore incorporating the liner system of FIG. 1A.

In another example, FIG. 1C depicts an implementation where the main well bore 18 is a substantially vertical well bore and the auxiliary well bore 20 is an articulated well bore deviating from the substantially vertical well bore. The articulated auxiliary well bore 20 of FIG. 1C includes a first portion 34 a second portion 38 deviating from a first portion 34 and a curved portion 40 between the first portion 34 and the second portion 38. The first portion 34 coincides with the main bore 18. In such an implementation, the junction liner 16 is positioned at a junction between the vertical main well bore 18 and the curved portion 40 of the auxiliary well bore 20. In both examples, FIG. 1B and IC, the auxiliary bore 20 is a bore drilled through the main bore 18.

Referring back to FIG. 1A, the main and auxiliary liners 12, 14 are made up of tubing 22 that may be continuous tubing over the entire length of the liner or may be lengths of tubing joined together, for example by tubing couplings 24. The main liner 12 includes one or more lateral windows or openings 30 (one shown in FIG. 1IA) that are shaped similarly to the projection of the auxiliary well bore 20 on the main liner 12. The junction liner 16 includes a tubular liner body 26. One end of the junction liner body 26 is adapted to connect to the auxiliary liner 14. The opposing end of the tubular liner body 26 includes a junction shield 28 extending outward therefrom. Like the lateral opening 30 of the main liner 12, the junction shield 28 has a similar shape to the projection of the auxiliary well bore 20 on the main liner 12. The junction shield 28, however, is sized slightly larger than the lateral opening 30. Furthermore, the junction shield 28 has a curvature that substantially follows the curvature of the outer diameter of the main liner 12. Accordingly, with the junction liner 16 positioned in the auxiliary bore 20 and the junction shield 28 abutting the outer surface of the main liner 12, the lateral opening 30 is substantially covered by the junction shield 28.

The junction shield 28 is adapted to flex inward, for example toward the central longitudinal axis of the junction liner 16, to enable the junction liner 16 with the junction shield 28 to pass through the interior of the main liner 12, as well as pass from the interior of the main liner 12 through the lateral opening 30 and into the auxiliary bore 20. Once outside of the main liner 12 and in the auxiliary bore 20, the junction shield 28 expands to substantially cover the lateral opening 30. Because it has expanded to a dimension larger than the lateral opening, for example a larger transverse dimension, the junction shield 28 cannot pass back through the lateral opening 30 and into the main line 12. In the illustrative junction liner 16 of FIG. 1A, the junction shield 28 is provided with one or more radial slits 32 extending from the perimeter of the junction shield 28 inward.

The radial slits 32 divide the junction shield 28 into segments that allow for circumferential movement between the segments as the junction shield 28 flexes inward.

The junction between the junction shield 28 and the lateral opening 30 need not be liquid tight, rather the junction shield 28 can loosely abut the outer surface of the main liner 12. A resulting clearance between the junction shield 28 and the main liner 12 may small, for example, 0.5-1 mm or larger and may be as large as several millimeters (3 mm-5 mm) or more, thereby allowing passage of liquid and fine particulate (ex. sand) into the interior of the liners 12, 14. Furthermore, the radial slits 32 are similarly sized to allow passage of liquid and fine particulate into the interior of the liners 12, 14. However, neither the clearance between the junction shield 28 and the main liner 12 nor the radial slits 32 allow passage of larger particulate. The illustrative liner system 10 is, therefore, particularly suited for subterranean formations that produce very little fine particulate.

For example, the material in many coal seams breaks-up or disassociates from the formation in larger particles that would not pass into the interior of the liners 12, 14 through the gaps. Further more the coal seam may not produce substantial amounts of fine particulate that may eventually erode and or clog the liners 12, 14. In one illustrative configuration, the clearance between the junction shield 28 and the main liner 12 is about 1 mm, as well as the largest spacing between radial slits 32 is about 1-2 mm. In this instance, gaps larger than 1 mm may be present, for example if the junction shield 28 is off-centered in the lateral opening 30, but such a clearance would initially prevent passage of all but a very small amount of the particulate (the ~2 mm and smaller particulate) disassociated from the coal seam. Furthermore, during operation, larger particulate will bridge the gaps and begin to block passage of finer particulate that would otherwise pass. However, if this configuration were used in an oil and gas formation, substantial quantities of sand would likely pass through the gaps. Also, because less larger particulate is encountered in an oil and gas formation, there is less larger particulate to bridge the gaps and reduce the amount of particulate passed as there is in coal seams. Because of the larger particulate in coal seams and the bridging effect, the clearance can be greater than 1 mm. For example, in yet another illustrative configuration, the largest clearance is about 3 mm. Again, larger gaps may be present, but after larger particulate begins bridging the gaps, the smaller particulate is blocked. It is also expected that clearances even larger than 3 mm, such as 5 mm and 8 mm can be used. While the liner system 10 is particularly suited for subterranean formation that produce very little fine particulate, the liner system 10 can be used in any type of subterranean formation.

Figure 2:
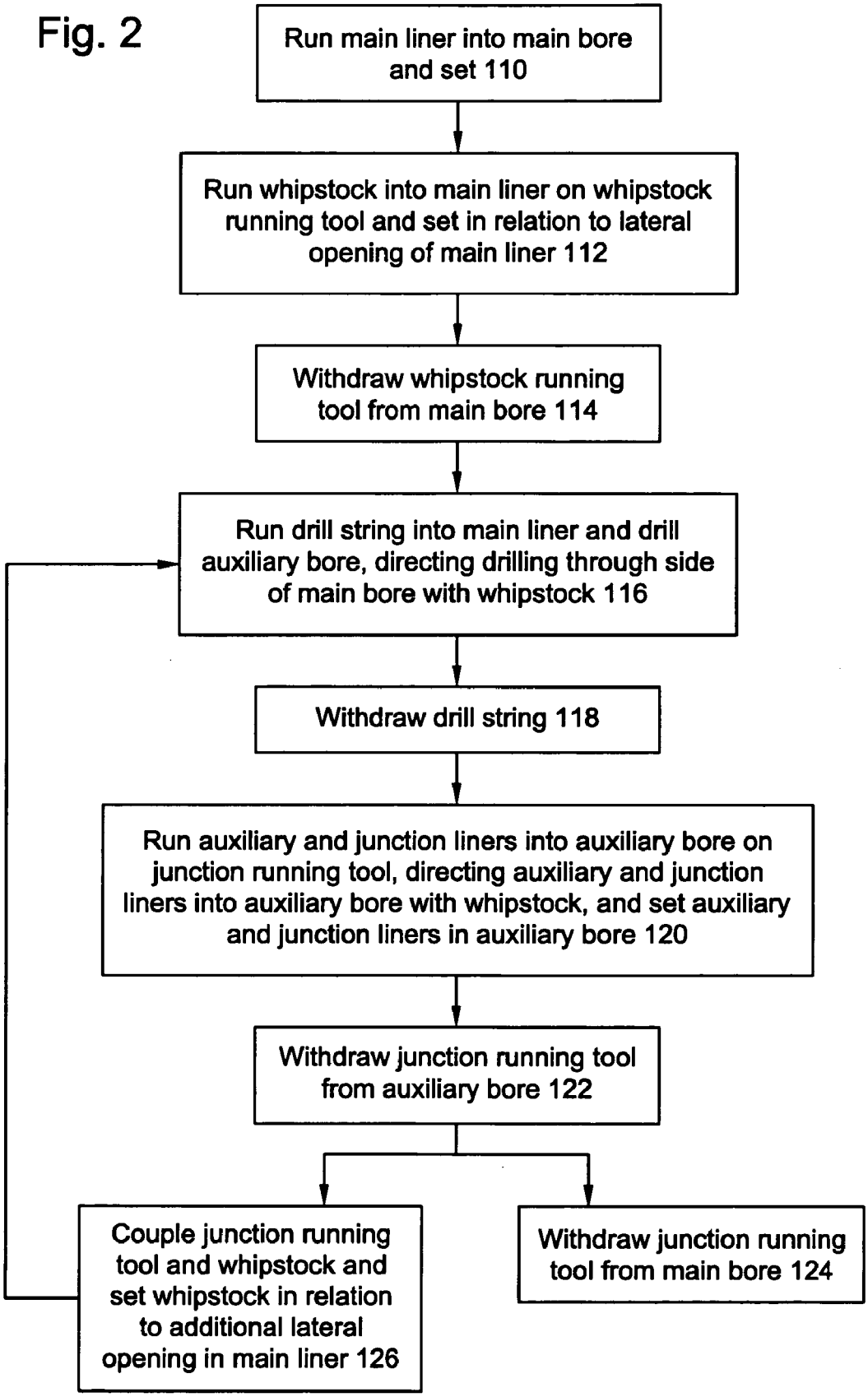
FIG. 2 is a flow diagram of an illustrative method of lining a well in accordance with the invention.

Turning now to FIG. 2, the illustrative liner system 10 is installed by first positioning the main liner 12 in the main well bore 18. Therefore, at block 110 the main liner 12 is run into the main well bore 18 and set in position. The location of one or more lateral openings 30 in the main liner 12 may be selected to correspond with the desired location of one or more auxiliary well bores 20, for example corresponding with subterranean zones of interest such as those bearing resources for example oil, gas, and coal. Once in position, the main liner 12 may be secured to the interior of the well bore 18, for example by a mechanical device (ex. a mechanical liner hanger) or cement (neither specifically shown).

At block 112 a whipstock 200 is run in through the interior of the main liner 12 on a whipstock running tool 300 and set in relation to a lateral opening 30 in the main liner 12. The whipstock 200 is a device adapted to deflect a drilling bit 54 (FIG. 4) into the wall of the main well bore 18 in drilling the auxiliary well bore 20. The whipstock 200, therefore, can be positioned below the first lateral opening 30 through which an auxiliary well bore 20 will be drilled. The whipstock 200 may then act to deflect the drilling bit 54 through the lateral opening 30 and into a wall of the main bore 18 at the desired location of the auxiliary well bore 20 to be drilled. If the main liner 12 is provided with multiple lateral openings 30, it may be desirable to position the whipstock 200 below the lateral opening 30 that is furthest downhole to enable auxiliary bores to be drilled through lateral openings 30 and lined in sequence. However, it is not necessary that the lateral openings 30 be drilled or lined in sequence or in any order.

The running tool 300 is a device adapted to selectively engage and release the whipstock 200, and may be attached to a working string 44. With the whipstock 200 engaged to the running tool 300, the whipstock 200 is lowered to the desired position within the main liner 12 and released from the running tool 300. Prior to release from the running tool 300, the whipstock 200 may be actuated to lock to an interior of the main liner 12. Thereafter, at block 114, the whipstock running tool 300 is withdrawn from the main well bore 18.

Figure 3A:
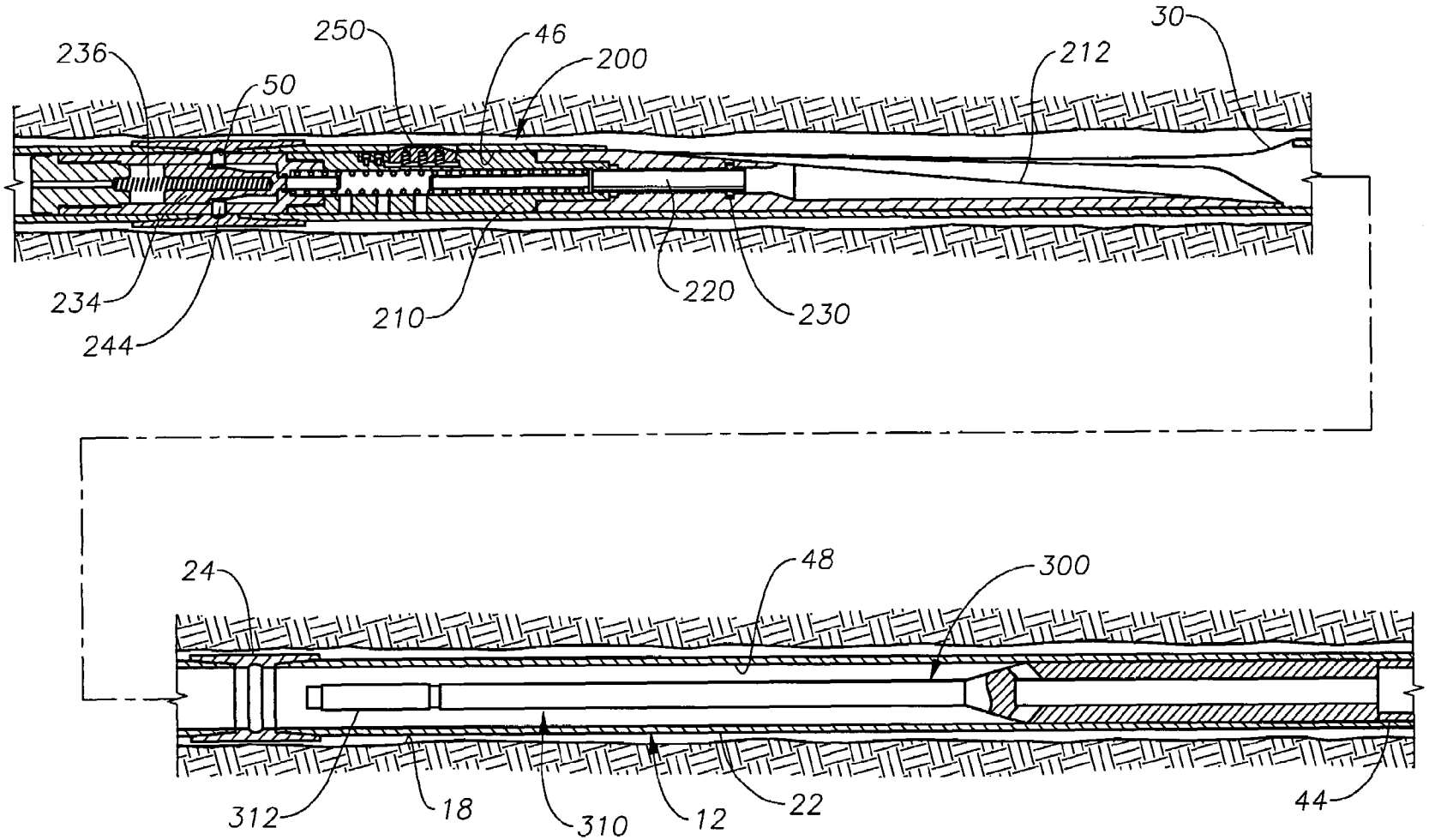
FIG. 3A is a cross-sectional view of an illustrative whipstock tool received in a main liner of a main bore and an illustrative whipstock running tool constructed in accordance with the invention.
Figure 3B:
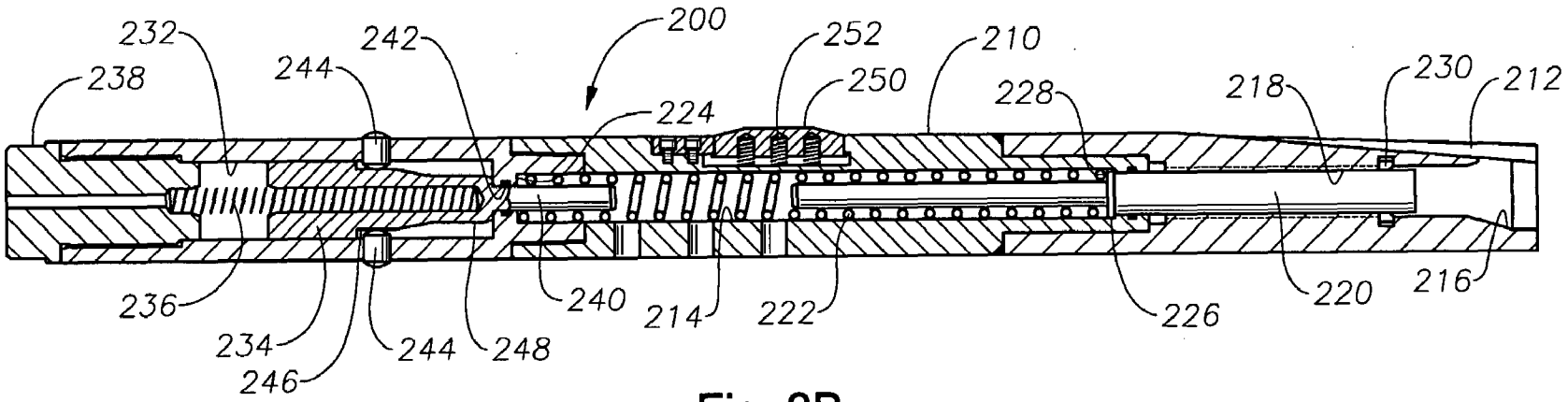
FIG. 3B is a cross-sectional detail view of the illustrative whipstock tool of FIG. 3A depicted with locking pins extended for engaging the main liner in accordance with the invention.
Figure 3C:
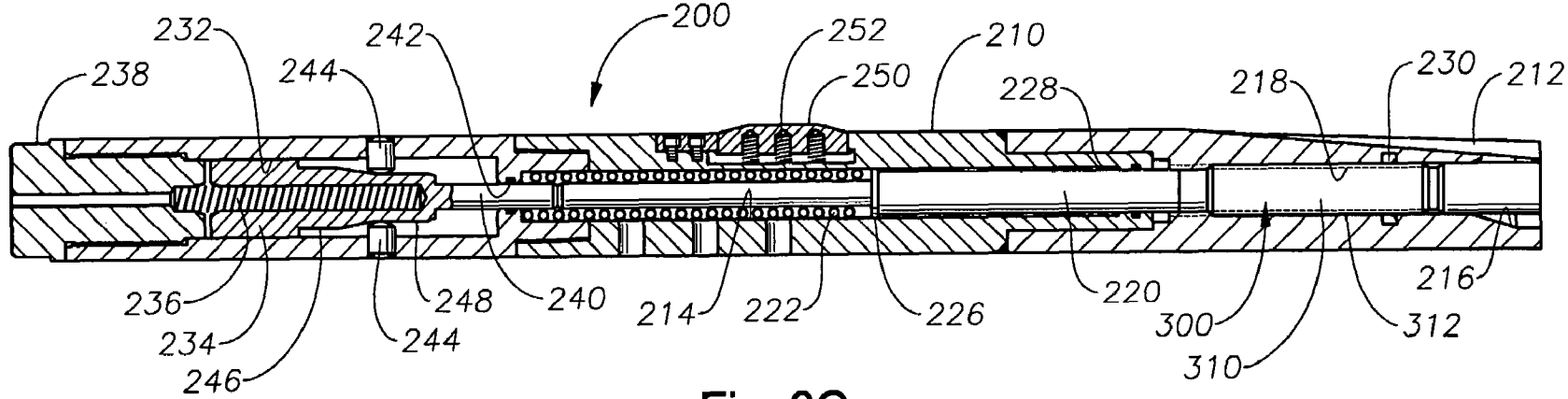
FIG. 3C is a cross-sectional detail view of the illustrative whipstock tool of FIG. 3A depicted with locking pins retracted in accordance with the invention.

Although numerous configurations of whipstock 200 and whipstock running tool 300 can be used according to the concepts described herein, an illustrative whipstock 200 and illustrative whipstock running tool 300 are depicted in FIGS. 3A-C. The illustrative whipstock 200 includes a body 210 that defines a deflecting surface 212. The deflecting surface 212 begins at one end of the body 210 and slopes at an acute angle relative to the whipstock 200 longitudinal axis. The deflecting surface 212 may be a substantially planar surface, or as is depicted in FIG. 3A, may have a curvature arcing about an axis parallel to the slope of the deflecting surface 212. The curvatures have a radius approximately equal to the internal radius of the main liner 12. The deflecting surface 212 is adapted to deflect a drilling bit 54 (FIG. 4) traveling along the longitudinal axis of the whipstock 200 (and thus main bore 18) laterally into a wall of the main bore 18.

As best seen in FIGS. 3B and 3C, the body 210 includes an elongated cavity 214 extending along the longitudinal axis of the whipstock 200. The cavity 214 has a running tool receiving opening 216 in the deflecting surface 212. The running tool receiving opening 216 may be flared to a larger transverse dimension, for example diameter, than the remainder of the cavity 214 to centralize an elongated stub portion 310 of the whipstock running tool 300 for receipt in the cavity 214. The stub portion 310 may include threads 312 adapted to engage mating threads 218 in the interior of the elongated cavity 214 to couple the running tool 300 to the whipstock 200. When coupled in this manner the running tool 300 can be used in positioning the whipstock 200 within the main liner 12. Unscrewing the threads 312, 218 releases the running tool 300 from the whipstock 200.

The elongated cavity 214 slidingly receives an actuator piston 220 therein. The actuator piston is biased within the elongated cavity 214 towards the running tool receiving opening 216 by a spring 222 acting against a lower end wall 224 of the elongated cavity 214. The actuator piston 220 includes a flange 226 abutting an upper shoulder 228 within the interior of the elongated cavity 214; the upper shoulder 228 acting as a stop to retain the actuator piston 220. A seal 230 may be provided in the elongated cavity 214 to substantially seal against passage of debris beyond the actuator piston 220 and into the lower portion of the elongated cavity 214.

The body 210 includes a lower cavity 232 that slidingly receives a cam actuator 234 therein. The cam actuator 234 is biased towards the upper end of the lower cavity 232 by a spring 236 acting against an end cap 238 at the lower end of the lower cavity 232. The cam actuator 234 has an elongated stub 240 that extends into the elongated cavity 214. A plurality of radially oriented locking pins 244 are received in the body 210. The locking pins 244 are radially extensible from being flush with an outer surface of the body 210 to extending outward from the outer surface of the body 210. When radially extended, the locking pins 244 are configured to engage a circumferential groove 50 (FIG. 4) to hold the whipstock 200 in relation to the lateral opening 30. The circumferential locating groove 50 is located within the main liner 12 such that when the locking pins 244 are engaged in the circumferential locating groove 50, the deflecting surface 212 of the whipstock 200 is positioned in relation to the lateral opening 30 to deflect drilling through the lateral opening 30. The cam actuator 234 has an outer profile with a first portion 246 that has a larger transverse dimension, for example diameter, than a transverse dimension, for example diameter, of a second portion 248. The locking pins 244 ride on the profile of the cam actuator 234 such that when abutting the first portion 246, as depicted in FIG. 3B, the locking pins 244 are extended. When abutting the second portion 248, as depicted in FIG. 3C, the locking pins 244 can retract.

As is best seen by comparing FIG. 3B to FIG. 3C, the whipstock running tool stub 310 acts on the actuator piston 220 to translate piston 220 downward in the elongated cavity 214 when the threads 312 are full received in the threads 218. The actuator piston 220, in turn, acts on the stub 240 of the cam actuator 234 to translate the cam actuator 234 downward in the lower cavity 232. Translating the actuator piston 220 from about the upper end of the lower cavity 232 as depicted in FIG. 3B, with the locking pins 244 abutting the larger first portion 246 of the cam actuator 234 and extended outward from the body 210, downward in the lower cavity 232 as is depicted in FIG. 3C, thus moves the second portion 248 under the locking pins 244 and allows the locking pins 244 to retract within the body 210. In other words, the whipstock 200 can be actuated between engaging the interior of the main liner 12 and releasing the interior of the main liner 12 by fully threading the running tool stub 310 into the elongated cavity 214 of the whipstock 200. The whipstock 200, however, can be configured such that partially threading the running tool stub 310 into the elongated cavity 214 of the whipstock 200 releases the whipstock 200 from engagement with the interior of the main liner 12 while maintaining the whipstock 200 coupled to the whipstock running tool 300. Spring 236 biases the actuator piston 220 in the upper position, and therefore biases the locking pins 244 extended to engage the interior of the main liner 12.

The main liner 12 is provided with a longitudinal alignment groove 46 below the lateral opening 30, and an additional longitudinal alignment groove 48 above the lateral opening 30. The body 210 of the whipstock 200 can include an outwardly biased fin 250, outwardly biased by springs 252, and adapted to be received in the longitudinal grooves 46,48. The alignment grooves 46, 48 and outwardly biased fin 250 are configured such that when the fin 250 is received in a groove 46, 48, the deflecting surface 212 of the whipstock 200 is oriented in relation to the lateral opening 30 to deflect a drilling bit 54 through the opening 30.

In operation, the stub 310 of the whipstock running tool 300 is stabbed through the opening 216 in the elongated cavity 214. The threads 312 are screwed into mating threads 218 thereby engaging the whipstock 200 to the whipstock running tool 300, and retracting the locking pins 244 within the body 210. The whipstock 200 is then passed through the main liner 12 on the whipstock running tool 300 until in the vicinity of the desired lateral opening 30. The whipstock 200, in the vicinity of the lateral opening 30, is rotated in the main liner 12 until the outwardly biased fin 250 drops into either of the alignment grooves 46, 48. Locking the outwardly biased fin 250 into an alignment groove 46, 48 allows the whipstock running tool 300 to be unthreaded from the whipstock 200. Accordingly, the whipstock running tool 300 is rotated to partially unscrew the threads 312 from the threads 218 and extend the locking pins 244 without releasing the whipstock 200 from the whipstock running tool 300. It can be determined whether the whipstock 200 is above or below the lateral opening 30 by applying torque to the whipstock 200, moving the whipstock 200 longitudinally in the groove 46, 48. If the fin 250 drops into the lateral opening 30, the whipstock 200 will rotate and indicate that the whipstock 200 was in the upper groove 48. If the locking pins 244 seat in the circumferential groove 50 and stop the whipstock's 200 longitudinal movement, the fin 250 was in the lower groove 48 and is now locked in and correctly oriented below the lateral opening 30.

Once the locking pins 244 have engaged the circumferential groove 50 the whipstock running tool 300 is unthreaded from the whipstock 200 and withdrawn from the main bore 18.

Figure 4:
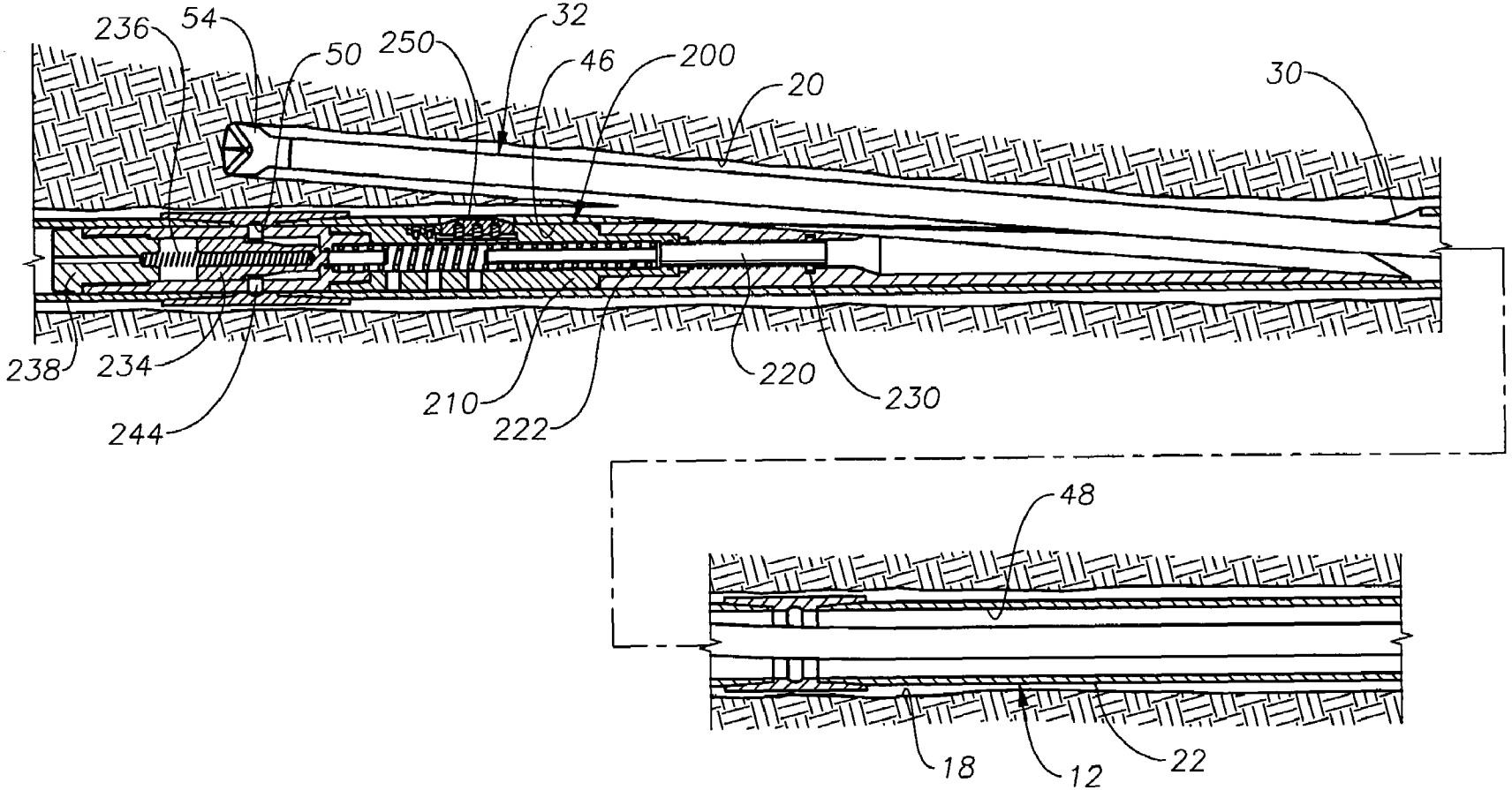
FIG. 4 is a cross-sectional view of the whipstock tool of FIG. 3A in use during drilling an auxiliary well bore deviating from the main well bore in accordance with the invention.

Referring back to FIG. 2 and also to FIG. 4, at block 116 a drilling string 52 including a drilling bit 54 is run in through the main liner 12 to drill the auxiliary bore 20. The drilling bit 54 deflects off the deflecting surface 212 of the whipstock 200, through the lateral opening 30 and into the wall of the main bore 18. The drilling bit 54 is then operated to drill the auxiliary bore 20. Of note, the angle at which the deflecting surface resides in relation to the longitudinal axis of the main bore 18 dictates the angle at which the auxiliary bore 20 will deviate, at least initially, from the main bore 18. When the auxiliary well bore 20 is complete, at block 118, the drilling string 52 is withdrawn from the main bore 18.

Figure 5:
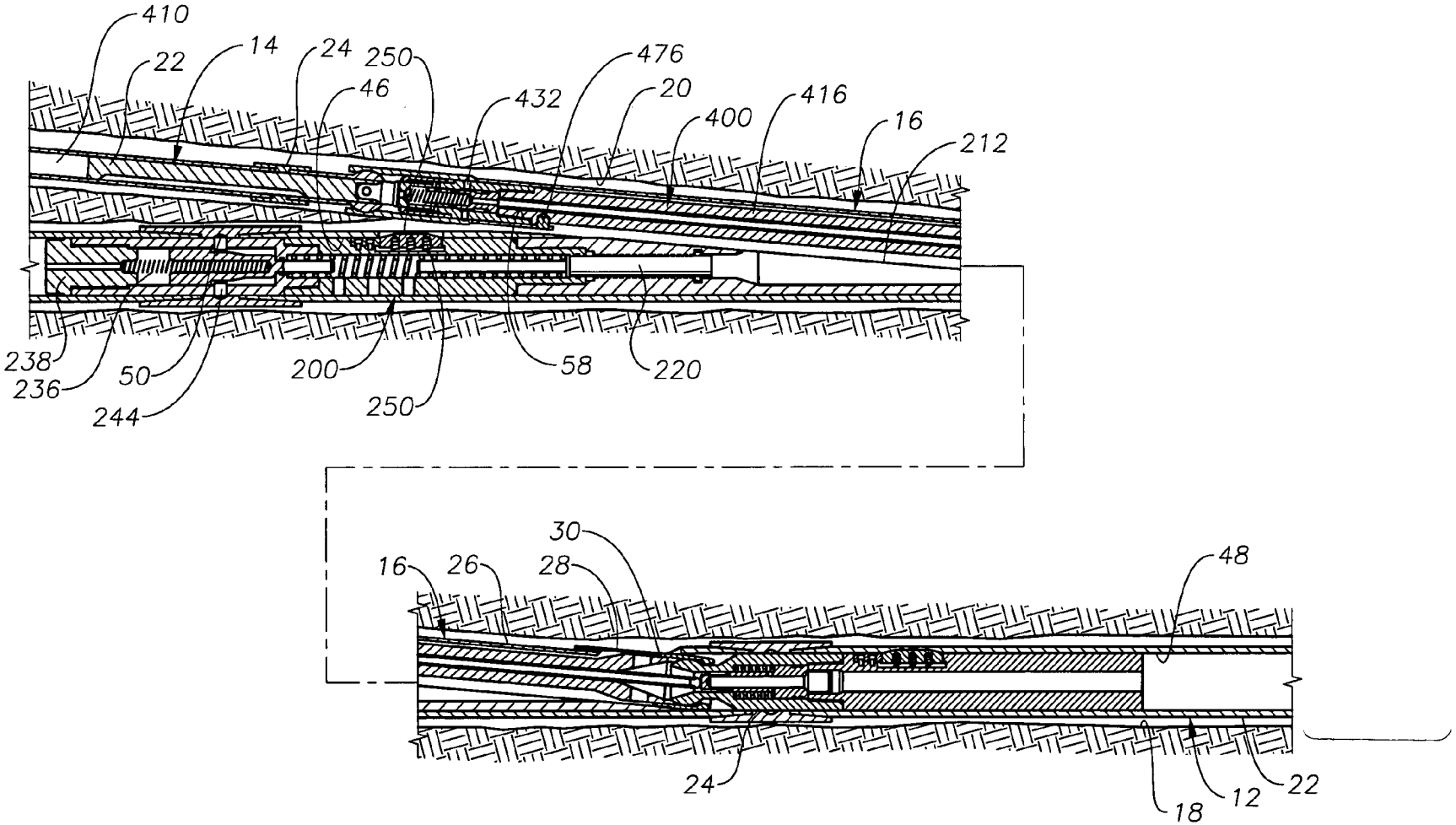
FIG. 5 is a cross-sectional view of an illustrative junction running tool run into the auxiliary well bore in installing the illustrative liner system in accordance with the invention.
Figure 11:
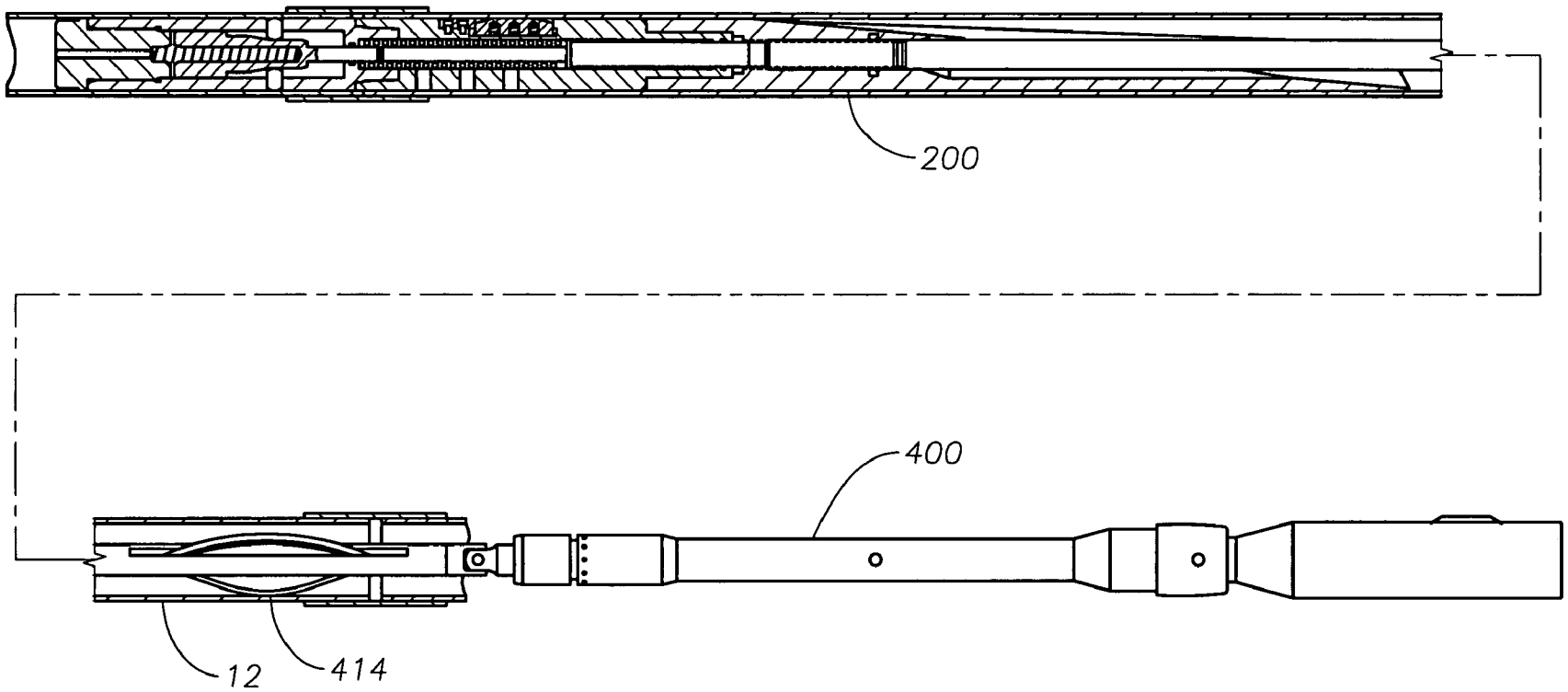
FIG. 11 is a cross-sectional view of the illustrative junction running tool of FIG. 6 repositioning the illustrative whipstock tool of FIG. 3A in accordance with the invention.

Referring to FIG. 2 and to FIG. 5, at block 120, the auxiliary liner 14 and junction liner 16 are run in through the main bore 18 and deflected by the deflecting surface 212 of the whipstock 200 laterally through the lateral opening 30 and into the auxiliary bore 20 and set in the auxiliary bore 20. The auxiliary liner 14 is depicted in FIG. 5 as being coupled to a junction liner 16. The auxiliary liner 14 and junction liner 16 are carried on a junction running tool 400. The junction running tool 400 is a device that is adapted to carry the auxiliary liner 14 and junction liner 16 and selectively lock into engagement with the liners 14, 16. The junction running tool 400 may be further adapted to selectively engage to manipulate and to actuate and release the whipstock 200 from engagement with an interior of the main liner 12. The junction running tool 400 is actuated to lock into engagement with the liners 14, 16 during running-in and positioning the auxiliary liner 14 and the junction liner 16 in the auxiliary bore 20. Once the auxiliary liner 14 and the junction liner 16 are in position, with the junction shield 28 in the auxiliary bore 20 and adjacent the outer surface of the main bore 18, the junction running tool 400 is actuated to release and deposit the liners 16 in the auxiliary bore 20. Thereafter, the junction running tool 400 may be withdrawn from the auxiliary bore 20 (block 122), and withdrawn from the main bore 18 (block 124), or remain in the main bore 18 and be used in repositioning the whipstock 200 (block 126) as is discussed below with respect to FIG. 11.

Figure 6:
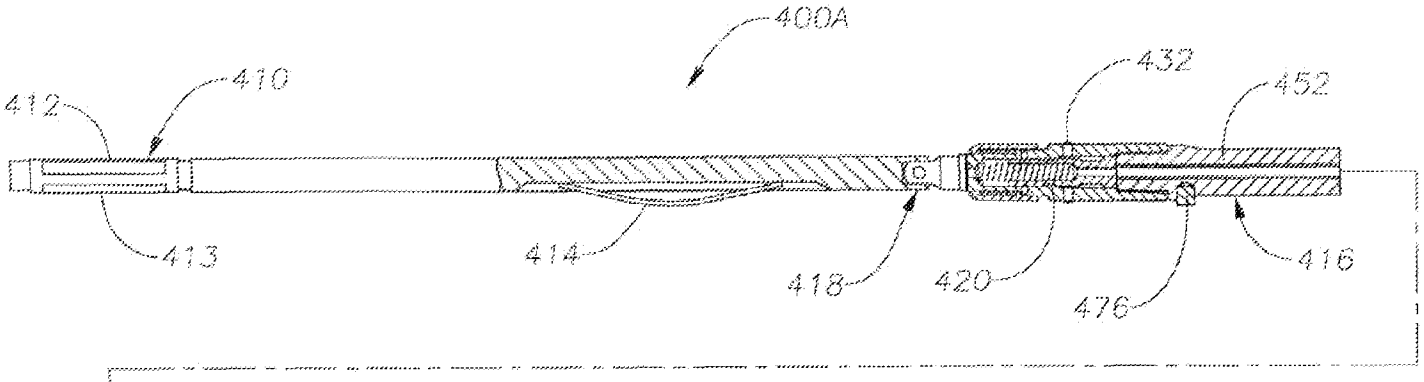
FIG. 6 is a cross-sectional view of an illustrative junction running tool constructed in accordance with the invention.
Figure 6:
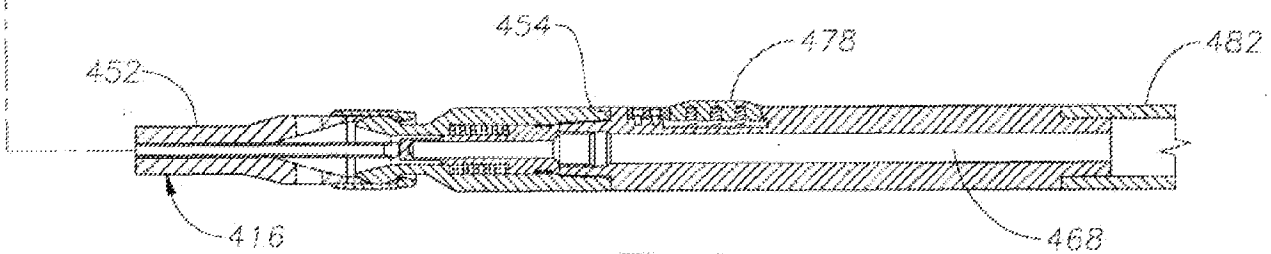
Figure 7:
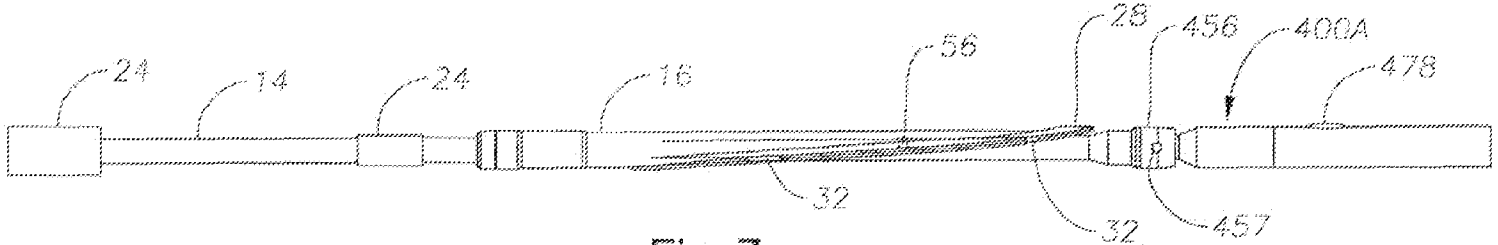
FIG. 7 is a cross-sectional view of the illustrative junction running tool of FIG. 6 receiving an illustrative auxiliary liner and an illustrative junction liner in accordance with the invention.

Although numerous configurations of junction running tools 400 can be used according to the concepts described herein, an illustrative junction running tool 400A is depicted in FIG. 6. The illustrative junction running tool 400A includes an elongated whipstock engaging stub 410 having threads 412 adapted to threadably engage the threads 218 of the whipstock 200. The whipstock engaging stub 410 is similar to the stub 310 of the whipstock running tool 300 discussed above, and thus enables the junction running tool 400A to engage to manipulate and actuate and to release the whipstock 200 in a similar manner to the whipstock running tool 300. The stub 410 can include one or more openings 413 in the threads 412 that provide a collection area for particulate in the threads 412 or threads 218, improving the ability of the threads 412 and threads 218 to mate when dirty. Furthermore, the whipstock engaging stub 410 can include one or more bow spring centralizers 414 sized to bear against the interior of the 12 and centralize the stub 410 to stab into the tool receiving opening 216 of the whipstock 200. A junction liner carrying assembly 416 is coupled to the whipstock engaging stub 410 at a universal joint 418. The universal joint 418 includes two oblique pivot axes that enable the whipstock engaging stub 410 to deflect laterally in relation to the junction liner carrying assembly 416, for example to articulate in traversing the transition from the main liner 12 into the auxiliary bore 20. As is seen in FIG. 7, the whipstock engaging stub 410 and junction liner carrying assembly 416 are adapted to be internally received in an auxiliary liner 14 and junction liner 16.

Figure 8A:
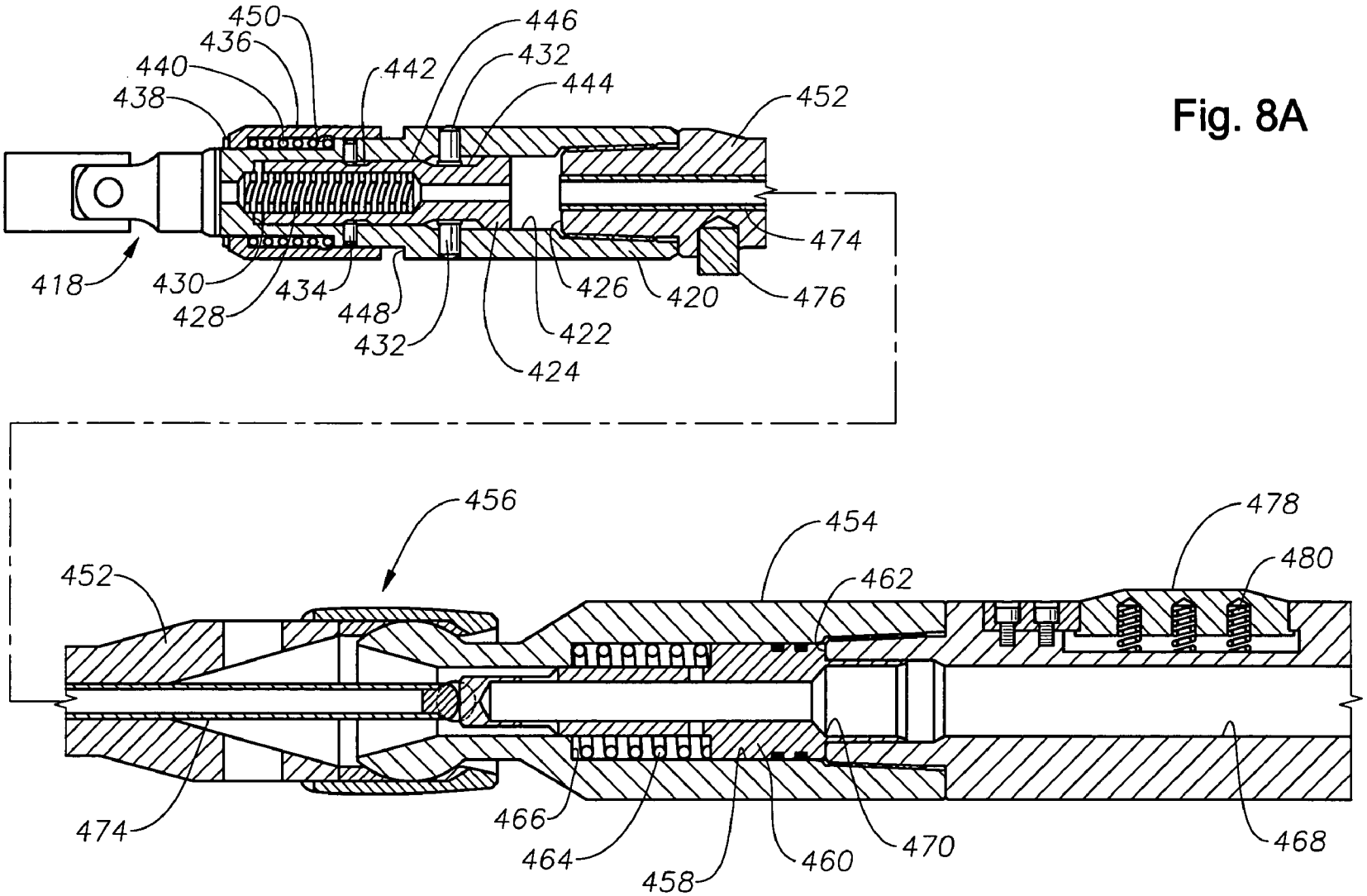
FIG. 8A is a cross-sectional detail view of the illustrative junction running tool of FIG. 6 prior to engaging the illustrative junction liner in accordance with the invention.
Figure 8B:
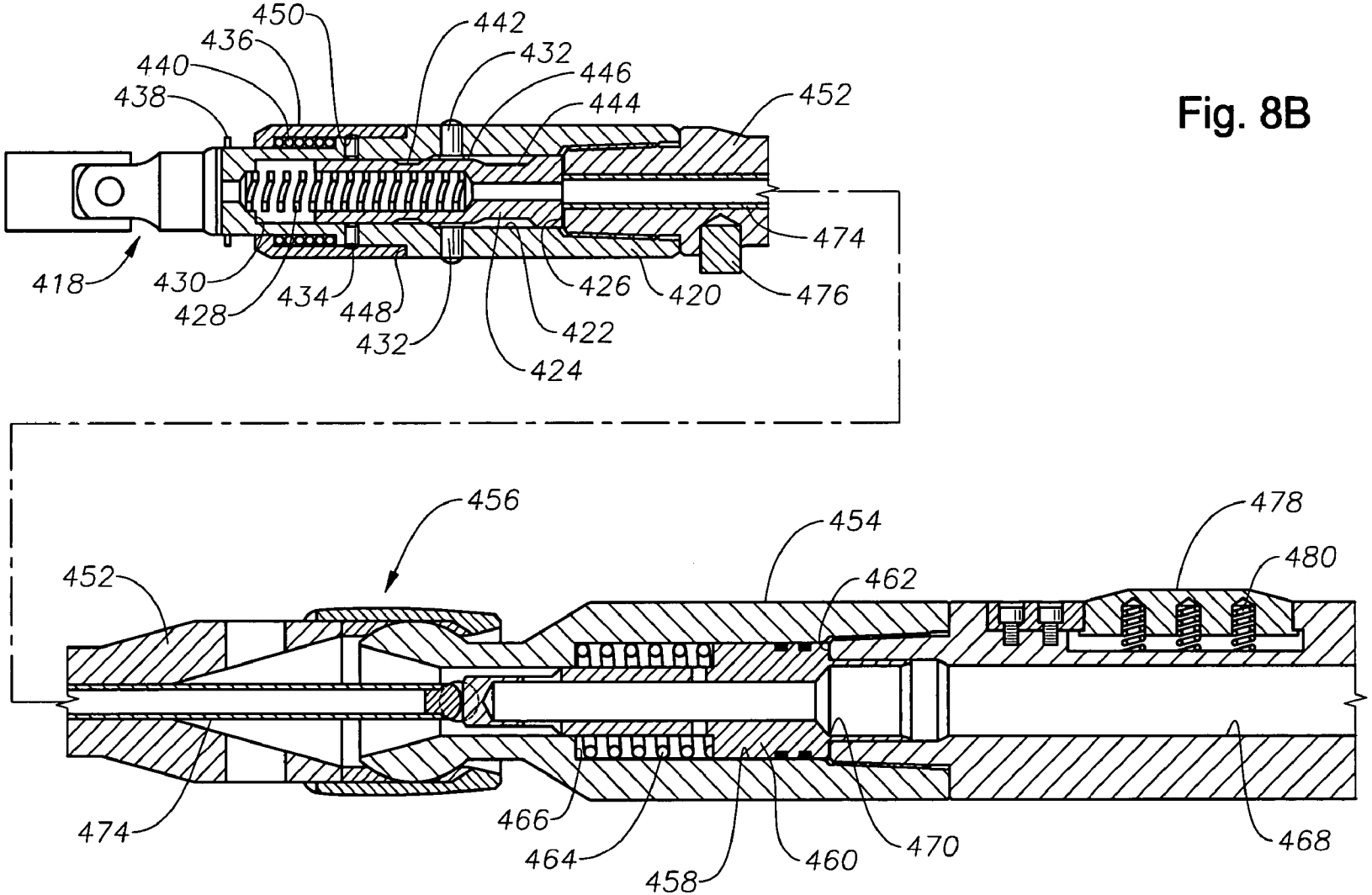
FIG. 8B is a cross-sectional detail view of the illustrative junction running tool of FIG. 6 activated to engage the illustrative junction liner in accordance with the invention.
Figure 8C:
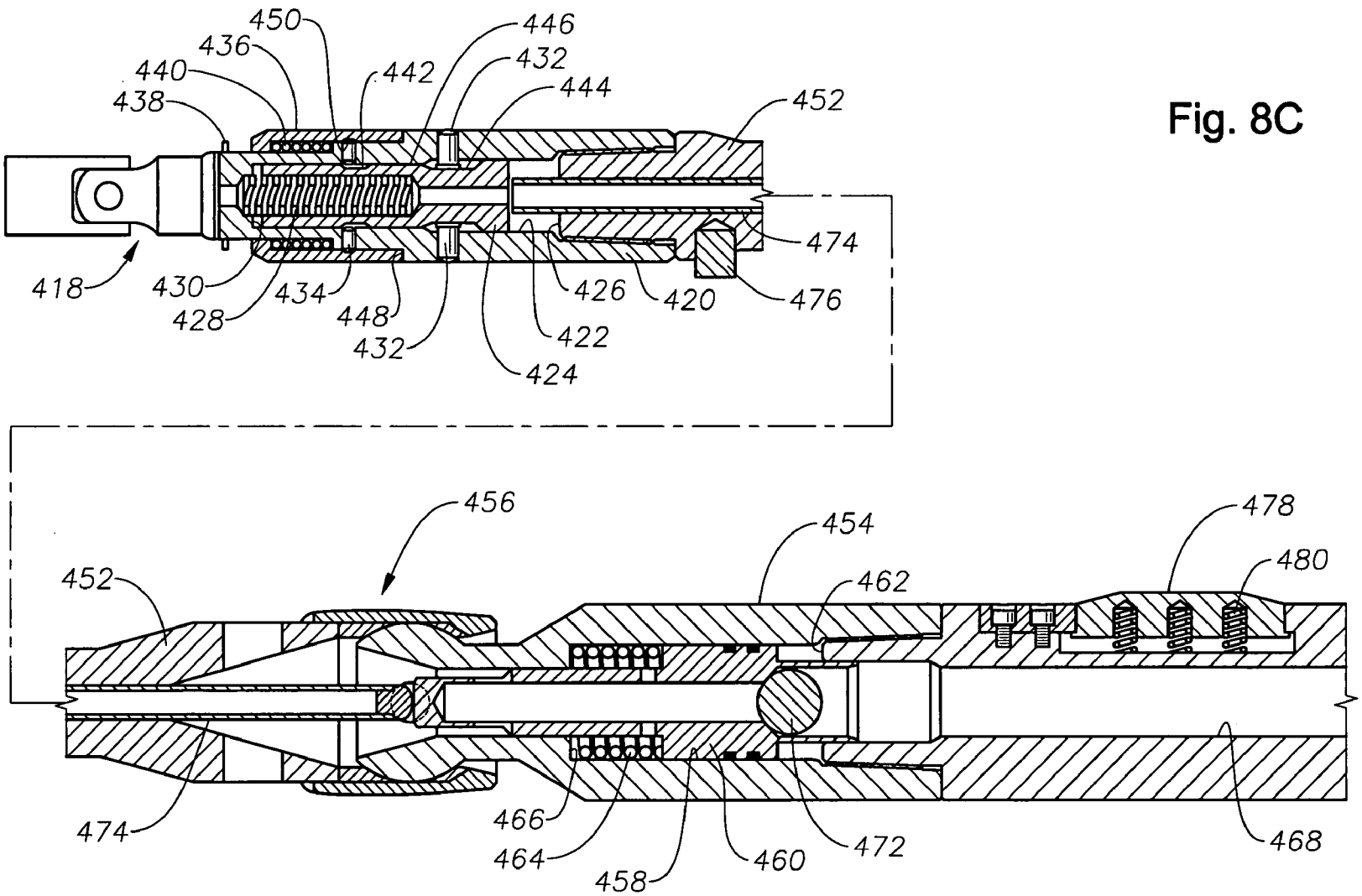
FIG. 8C is a cross-sectional detail view of the illustrative junction running tool of FIG. 6 activated to release the illustrative junction liner in accordance with the invention.

In general terms, the junction liner carrying assembly 416 is actuable to lock into engagement with the junction liner 16 to thereby lock the junction liner 16 and auxiliary liner 14 onto the junction running tool 400A. The details of the illustrative junction liner carrying assembly 416 are depicted in FIGS. 8A-8C. FIG. 8A depicts the junction liner carrying assembly 416 actuated to receive the junction liner 16. FIG. 8B depicts the junction liner carrying assembly 416 actuated to lock into engagement with the junction liner 16. FIG. 8C depicts the junction liner carrying assembly 416 actuated to release the junction liner 16.

The junction liner carrying assembly 416 includes a lower body 420 that defines an interior cavity 422 therein. The lower body 420 internally receives a cam actuator 424 biased towards an upper end 426 of the cavity 422 by a spring 428 acting against a lower end 430 of the cavity 422. In FIG. 8A, the cam actuator 424 is retained about the lower end 430 of the cavity 422 by one or more radially oriented cam actuator locking pins 434. The cam actuator locking pins 434, when retracted within the lower body 420, are received in a detent groove 442 of the cam actuator 424. The cam actuator locking pins 434 bear against the side of the detent the groove 442 and retain the cam actuator 424 in position at the lower end 430 of the cavity 422. An actuator sleeve 436 is received over the lower end of the lower body 420 and is biased against a stop 438 by a spring 440. When abutting the stop 438 the actuator sleeve 436 retains the cam actuator locking pins 434 in the detents 442 of the cam actuator 424, and thereby retains the cam actuator 424 at the lower end 430 of the cavity 422. The actuator sleeve 436 may slide upward to abut a shoulder 448 of the lower body 420 and align a detent groove 450 therein over the cam actuator locking pins 434 (FIG. 8B). Aligning the detent groove 450 over the cam actuator locking pins 434 allows the cam actuator locking pins 434 to extend out of engagement with the detent groove 442 and release the cam actuator 424 to translate to the upper end 426 of the cavity 422.

The outer dimension of the actuator sleeve 436 is configured to abut an interior of the junction liner 16 and be translated upward into abutting engagement with the shoulder 448 when the junction liner 16 is received over the junction running tool 400A. Accordingly, prior to receipt of the junction liner 16, the actuator sleeve 436 is positioned to abut the lower stop 438 and retain the cam actuator 424 about the lower end 430 of the cavity 422 (FIG. 8A). As the junction liner 16 is received over the junction liner carrying assembly 416, it drives the actuator sleeve 436 towards the shoulder 448 of the lower body 420 (see FIG. 8B), aligns the detent groove 442 over the cam actuator locking pins 434 enabling the locking pins 434 to extend, and releases the cam actuator 424 to translate towards the upper end 426 of the cavity 422.

The lower body 420 includes one or more radially oriented junction liner locking pins 432 spaced from the cam actuator locking pins 434. The junction liner locking pins 432 ride on a first outer surface 444 and second outer surface 446 of the cam actuator 424; the first surface 444 having a smaller transverse dimension than the second surface 446. The junction liner locking pins 432 abut the first surface 444 when the cam actuator 424 is at the lower end 430 of the cavity 422. When the cam actuator 424 translates towards the upper end 426 of the cavity 422 (see FIG. 8B), the junction liner locking pins 432 ride up onto the second surface 446 and are extended outward from the lower body 420. By extending the junction liner locking pins 432 in this manner, the junction liner locking pins 432 are extended into locking pin receiving apertures 58 in the junction liner 16 (best seen in FIG. 5). Accordingly, when the junction liner 16 is received over the junction running tool 400A, it slides the actuator sleeve 436 to abut the shoulder 448 and release the cam actuator locking pins 434, thereby allowing the cam actuator 424 to translate to the upper end 426 of the cavity 422 and drive the junction liner locking pins 432 outward into receiving apertures 56. Extending the junction liner locking pins 432 outward into the receiving apertures 56 of the junction liner 16 locks the junction liner 16 to the junction running tool 400A.

The junction running tool 400A includes an intermediate body 452 coupled to an upper body 454 at a spherical joint 456. The spherical joint 456 enables the intermediate body 452 to deflect laterally in relation to the upper body 454, for example to articulate in traversing the transition from the main liner 12 into the auxiliary bore 20. The spherical joint 456 is pinned 457 (see FIG. 7) to allow transmission of torque through the joint 456. The upper body 454 is adapted to attach to a tubing string 482 (FIG. 6) for manipulating the junction running tool 400A in the main and auxiliary bores 18, 20. The upper body 454 defines an interior cavity 458 that receives a release actuator 460 therein. The release actuator 460 is biased to an upper end 462 of the cavity 458 by a spring 464 active upon the lower end 466 of the cavity 458. The release actuator 460 abuts an actuator rod 474 passing through the interior of the intermediate body 452 and to the lower body 420. The end of the actuator rod 474 is flush with the upper end 426 of the cavity 422 when the release actuator 460 abuts the upper end 462 of the cavity 458 in the upper body 454. However, when the release actuator 460 is translated towards the lower end 466 of the cavity 458, it acts upon the actuator rod 474 thereby translating the actuator rod 474 into the cavity 422 of the lower body 420. Translating the actuator rod 474 into the cavity 422 of the lower body 420 causes the actuator rod 474 to act upon the cam actuator 424 thus driving the cam actuator 424 towards the lower end 430 of the cavity 422.

The upper body 454 includes an interior passage 468 in communication with the interior of the tubing string. The release actuator 460 includes a spherical ball seat 470 adapted to receive and seal against a spherical ball 472 (FIG. 8) pumped from the surface into the interior passage 468 and into the ball seat 470. When a spherical ball 472 is received in the ball seat 470, pressure introduced through the interior passage 468 acts on the spherical ball 472 and release actuator 460 to translate the release actuator 460 towards the lower end 466 of the cavity 458. Translation of the release actuator 460 towards the lower end 466 of the cavity 458 translates the actuator rod 474 to act upon the cam actuator 424 in the lower body 420. Accordingly, by introducing a spherical ball 472 into the ball seat 470 and by applying pressure through the interior passage 468, the cam actuator 424 can be translated towards the lower end 430 of the cavity 422 thereby enabling the junction locking pins 432 to be retracted. Thereafter, the junction running tool 400A may be withdrawn from the auxiliary liner 14 and junction liner 16.

The intermediate body 452 includes a stub 476 extending outward therefrom and adapted to be received in a corresponding stub groove 58 (see FIG. 5) of the junction liner 16. Receipt of the stub 476 in a stub groove 58 aligns the junction liner 16 circumferentially with the junction running tool 400, so that the junction liner locking pins 432 can be received in the corresponding locking pin apertures 56, and so that the junction shield 28 of the junction liner 16 is oriented in a specified orientation relative to the junction running tool 400. The upper body 454 further includes an extendable fin 478 biased outward by springs 480. Like the fin 250 of the whipstock 200, the fin 478 is adapted to be received in the longitudinal groove 48 of the main liner 12 to align the junction running tool 400 relative to the main liner 12. The fin 478 is positioned in relation to the stub 476 such that when received in the longitudinal groove 48 above the lateral opening 30 the junction shield 28 is oriented in relation to the lateral opening 30.

Figure 9:
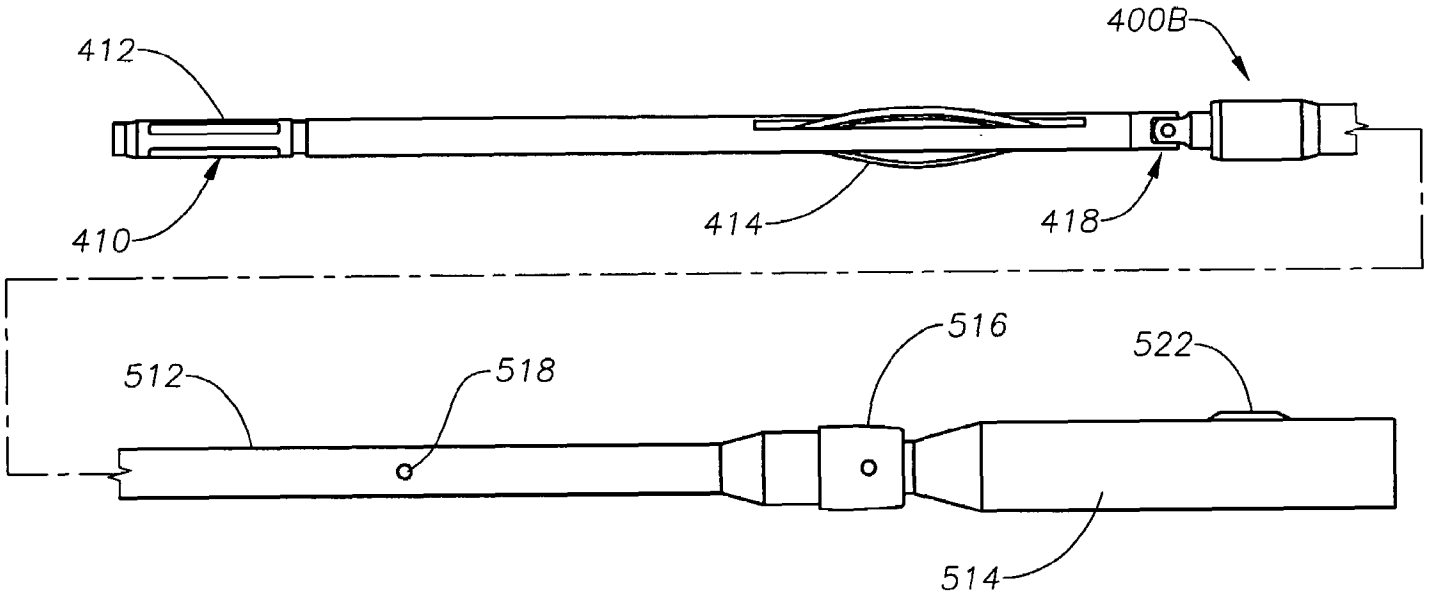
FIG. 9 is a cross-sectional detail view of another illustrative junction running tool constructed in accordance with the invention.
Figure 10:
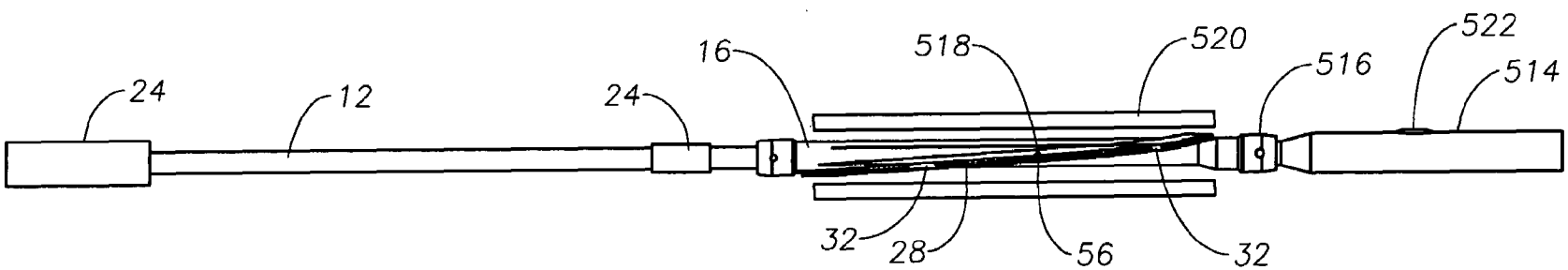
FIG. 10 is a cross-sectional detail view of the alternate illustrative junction running tool of FIG. 9 receiving an illustrative auxiliary liner and an alternate illustrative junction liner in accordance with the invention.

FIG. 9 depicts an alternate illustrative junction running tool 400B. The alternate illustrative junction running tool 400B is similar to the illustrative junction running tool 400 of FIG. 6, except that it engages the junction liner 16 in a different manner. To this end, the alternate junction running tool 400B includes a whipstock engaging stub 410 coupled to a junction liner carrier assembly 510. The junction liner carrying assembly 510 includes a lower body 512 coupled to an upper body 514 at a joint 516 (for example, a spherical joint pinned as discussed above). Rather than having extendable junction liner locking pins as discussed above, the alternate junction running tool 400B includes one or more fixed junction liner locking pins 518. The fixed junction liner locking pins 518 are radially oriented and are fixed extending outward from the lower body 512. When the junction liner 16 is received over the junction liner carrying assembly 510, as is depicted in FIG. 10, the junction liner 16 may be compressed with a clamp device or frusto-conical guide 520 that inwardly compresses the junction liner 16 towards the junction liner carrying assembly 510. Inwardly compressing the junction liner 16 flexes the junction liner inward to bring the locking pin apertures 56 into engagement with the fixed junction liner locking pins 518, thereby locking the junction liner 16 to the junction running tool 400B. The clamp device 520 is retained on the junction liner 16 while the auxiliary liner 14 and the junction liner 16 are inserted into the main liner 12, and withdrawn from the junction liner 16 as the junction liner is received entirely within the main liner 12. Thereafter, when the junction liner 16 passes into the auxiliary bore 20 it expands and releases the locking pins 518 from the locking pin apertures 56, thus releasing the junction liner 16 from the running tool 400B. The upper body 514 includes an outwardly biased extendable fin 522, similar to the extendable fin 478 of the junction running tool 400A.

Referring back to FIG. 5, in either instance of the junction running tool 400 or alternate junction running tool 400B the auxiliary liner 14 and junction liner 16 are run in through the main liner 12 and deflected off of the deflecting surface 212 of the whipstock 200 and into the auxiliary bore 20. Once the junction shield 28 of the junction liner 16 has passed through the lateral opening 30 of the main liner 12, the junction liner 16 is released from the junction liner running tool 400. In the instance of the illustrative junction liner running tool 400A of FIG. 6, a spherical ball 472 is pumped down into the ball seat 470 and pressure is applied to the spherical ball to retract the junction liner locking pins 432 and release the junction liner 16. In an instance of the illustrative junction liner running tool 400B of FIG. 9, passage of the junction shield 28 through the lateral opening 30 and into the auxiliary liner 14 allows the junction liner 16 to expand and release the junction liner locking pins 518 from the locking pin apertures 56. The locking pin apertures 56 may be located on the sloped portion of junction shield 28 to facilitate disengagement from the locking pins 518. Thereafter, the junction running tool 400 can be withdrawn from the auxiliary bore 14, and if no further operations are desired, withdrawn from the main bore 18.

If it is desired to line an additional auxiliary bore 20, the junction running tool 400 can be lowered such that the whipstock engaging stub 410 is received in the open end 216 of the elongated cavity 214 of the whipstock 200. Thereafter the threads 412 of the whipstock engaging stub 410 on the junction running tool 400 can be engaged to the threads 218 of the whipstock 200 thereby actuating whipstock 200 to retract the locking pins 244 in engagement with the interior of the main liner 12. Retracting the locking pins 244 from engagement with the main liner 12 frees the whipstock 200 to translate within the main liner. The whipstock may then be repositioned beneath another lateral opening 30 on the junction running tool 400 as discussed above with positioning the whipstock 200 on the whipstock running tool 300. Thereafter, the threads 412 of the whipstock engaging stub 410 of the junction running tool 400 can be disengaged from the threads 218 of the whipstock 200 and the junction running tool 400 withdrawn from the main well bore 18. An additional auxiliary liner 14 and junction liner 16 may be locked onto the junction running tool 400 and run into the main well liner 12 and set in the auxiliary well bore 20 as is discussed above.

Figure 12A:
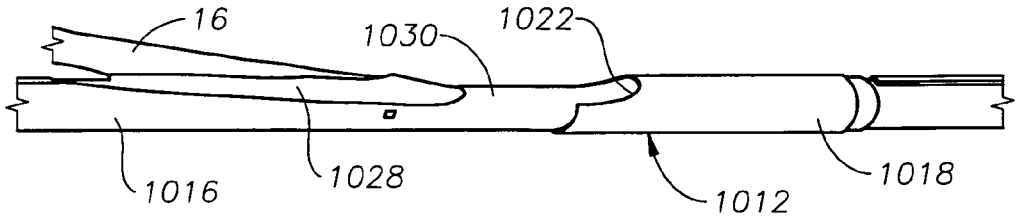
FIG. 12A is a perspective view of an alternate illustrative liner system constructed in accordance with the invention including a liner opening cover in an open position.
Figure 12B:
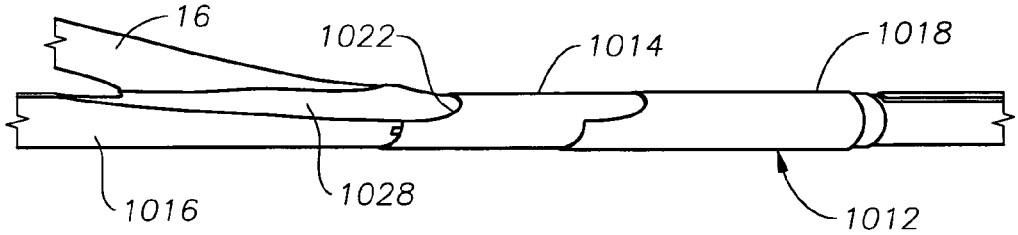
FIG. 12B is a perspective view of the alternate illustrative liner system of FIG 12A with the liner opening cover in a closed position.

Turning now to FIG. 12A and 12B, an alternate illustrative main well liner 1012 having a retractable lateral opening cover 1014 may be substituted for the main liner 12 discussed above. The illustrative main well liner 1012 includes a tubing 1016 including one or more lateral openings 1030. A secondary tubing 1018 is substantially concentrically received over and affixed to exterior of the tubing 1016 to define an annular cavity 1020 therebetween. The annular cavity 1020 substantially concentrically receives a tubular lateral opening cover 1014, such that the lateral opening cover 1014 can slide into the annular cavity 1020 substantially parallel to the longitudinal axis of the main well liner 1012. The lateral opening cover 1014 can be changed between an open position, depicted in FIG. 12A, and a closed position, depicted in FIG. 12B. In the closed position (FIG. 12B), the lateral opening cover 1014 may abut one or more stops 1024 that limit the movement of the lateral opening cover 1014. Additionally, in the closed position, the lateral opening cover 1014 may abut an edge of the shield flange 1028 of the junction liner 16, thereby substantially spanning gaps between the shield flange 1028 and the edge of the lateral opening 1030. The leading edge 1022 of the lateral opening cover 1014 may follow the curvature of the shield flange 1028 and lateral opening 1030 minimized gaps between the shield flange 1028 and the lateral opening cover 1014. It is appreciated that the lateral opening cover 1014 may loosely abut the shield flange 1028, allowing passage of liquid and fine particulate, such as sand, but filtering passage of larger particulate, such as disaggregated coal.

The alternate illustrative main liner 1012 is run into the main bore 18 (FIG. 1A) with the lateral opening cover 1014 in the open position. The lateral opening cover 1014 can then be moved to the closed position concurrently with or after the auxiliary liner 14 (FIG. 1A) and junction liner 16 are positioned in the auxiliary bore 20. Although there are numerous manners in which the lateral opening cover 1014 can be closed, in one instance, a junction running tool 400 can be adapted to draw the lateral opening cover 114 closed concurrently with or after the auxiliary liner 14 and junction liner 16 are positioned in the auxiliary bore 20.

Figure 14:
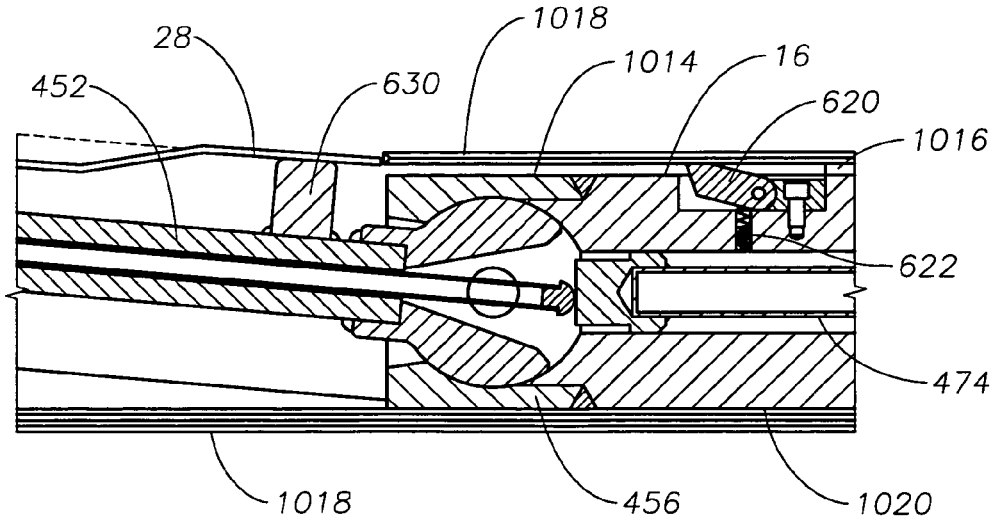
FIG. 14 is a detailed cross-sectional view of the alternate illustrative junction running tool of FIG. 13.
Figure 13:
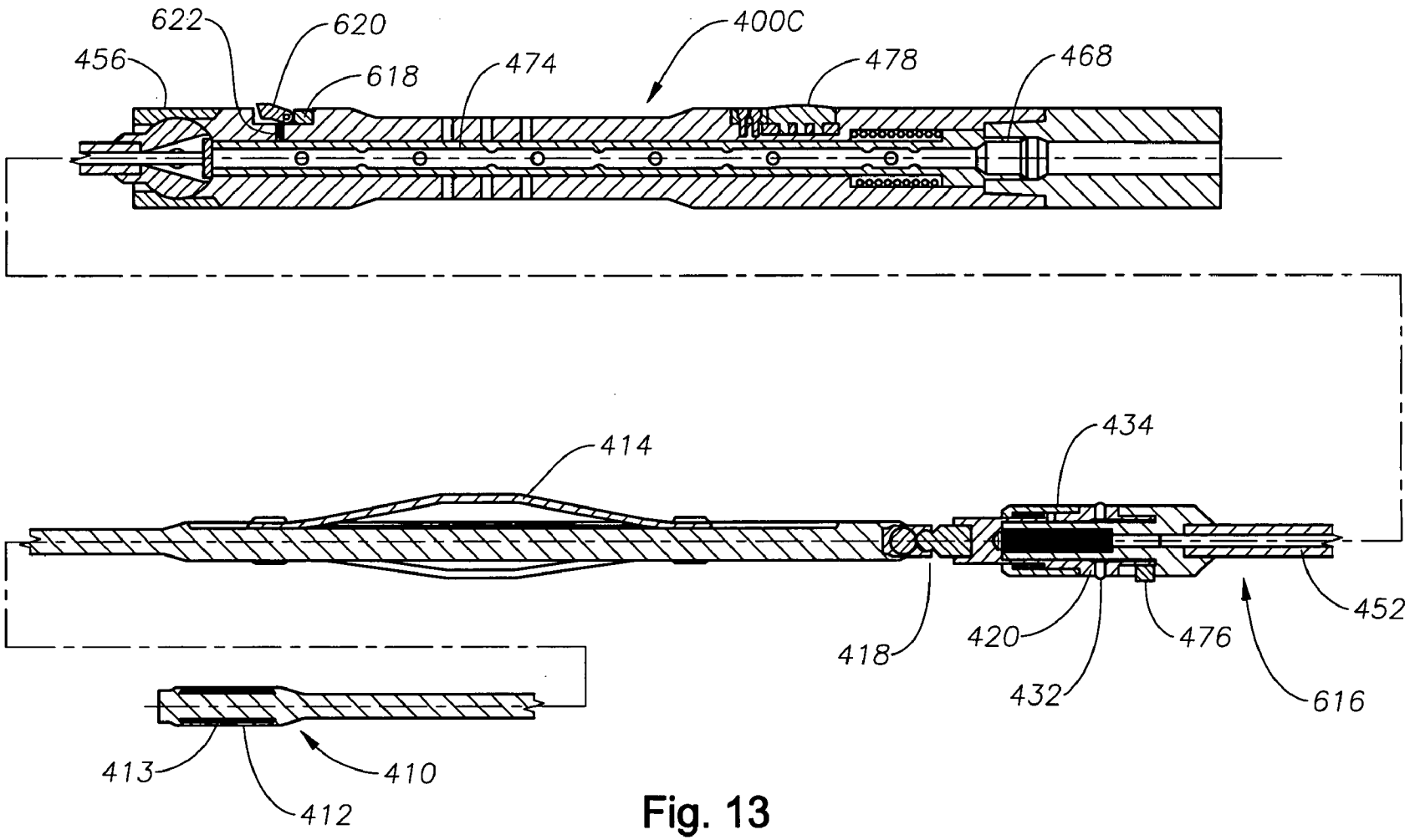
FIG. 13 is a cross-sectional view of an alternate illustrative junction running tool constructed in accordance with the invention and adapted to close the liner opening cover.

An illustrative junction running tool 400C having provisions to close the lateral opening cover 1014 is depicted in FIG. 13. The illustrative junction running tool 400C is provided with an extendable finger 620 biased outward by a spring 622. As is best seen in FIG. 14, the extendable finger 620 can be selectively aligned with and extend into a slot 1026 in the main tubing 1016. When extended into the slot 1026, the extendable finger 620 is able to engage the trailing edge 1032 of the lateral opening covering 1014.

The extendable finger 620 may then draw the lateral opening covering 1014 closed as the illustrative junction running tool 400C is passed through the main liner 1012. The illustrative junction running tool 400C is configured to draw the lateral opening covering 1014 closed as the junction liner 16 is passed through the lateral opening 1030 and fully closed when the junction liner 16 is in final position in the auxiliary bore 20 (FIG. 1). Therefore, the lateral opening cover 1014 then substantially covers gaps between the lateral opening 1030 and the junction liner 16 shield flange.

When not aligned with the slot 1026, the extendable finger 620 slides against the interior of the main tubing 1016, but does not catch the trailing edge 1032 of the lateral opening covering 1014 because the trailing edge 1032 shielded by the main tubing 1016. Therefore, in a configuration having multiple lateral openings 1030, the extendable finger 620 can be oriented away from the slots 1026 as the illustrative junction running tool 400C is passed through the main liner 1012 to prevent unintentionally closing lateral opening covers 1014. To facilitate aligning the extendable finger 620 with the slots 1026 in the main liner 1012, the extendable finger 620 can be oriented in relation to the alignment fin 478 such that when the alignment fin 478 is received in the longitudinal groove 48 (FIG. 5) the extendable finger 620 is aligned with the slots 1026.

As is seen in FIG. 14, the illustrative junction running tool 400C can be provided with a junction liner support 1032 that extends radially outward therefrom. The junction liner support 1032 is adapted to span between the junction running tool 400C and the interior of the junction shield flange 1028 to limit inward flexure of the shield flange 1028 and limit passage of debris into the interior of the junction liner. By limiting the inward flexure of the shield flange 1028, the junction liner support 1032 ensures that the shield flange 1028 cannot flex inward and hang underneath the leading edge 1022 of the lateral opening cover 1014 when the junction running tool 400C is withdrawn. If the shield flange 1028 were to hang underneath the leading edge 1022 of the lateral opening cover 1014 when the junction running tool 400C is withdrawn, it may draw the lateral opening cover 1014 partially open. By limiting passage of debris into the interior of the junction liner, the junction liner support 1032 substantially prevents lodging of debris between the shield flange 1028 and the leading edge 1022 of the lateral opening cover 1014. Such debris may likewise push the lateral opening cover 1014 partially open as the junction running tool 400C is withdrawn and may otherwise interfere with operation of the system.

Referring to FIGS. 1, 12A, 12B and 13 collectively, in operation, the auxiliary liner 14 and junction liner 16 are received over the illustrative junction running tool 400C and run into the main liner 1012. Until in the vicinity of the desired lateral opening 1030, the extendable finger 620 is maintained out of the respective slots 1026 of other lateral openings 1030. Thereafter, the illustrative running tool 400C can be rotated until the alignment fin 478 engages a longitudinal groove 48, thereby aligning the extendable finger 620 with a slot 1026. The auxiliary liner 14 and junction liner 16 are deflected off the whipstock 200 and then run into the auxiliary bore 20. As the auxiliary liner 14 and junction liner 16 are run into the auxiliary bore 20, the extendable finger 620 extends into a slot 1026, engages the trailing edge 1032 of the lateral opening cover 1014, and draws the lateral opening cover 1014 closed.

Use of a main liner 1012 with a lateral opening cover 1014 allows the lateral window 1030 to be larger than in a configuration without a lateral opening cover 1014, because the a gap between the junction liner 16 and the lateral opening 1030 can be covered by the lateral opening cover 1014. Such larger lateral opening 1030 allows greater freedom to insert the auxiliary liner and the junction liner into the auxiliary bore. Furthermore, the junction liner 16 need not be provided with a shield flange adapted to flex inward as it passes through the lateral opening, such as shield flange 28 discussed above. Rather shield flange 1028 can be rigid and sized slightly smaller than the lateral opening 1030, and any gaps between the shield flange 1028 and the edge of the lower opening 1030 can be made up by the lateral opening cover 1014.

A number of embodiments of the invention have been described. Nevertheless, it will be understood that various modifications may be made without departing from the spirit and scope of the invention. For example, although discussed in relation to lining a main well bore prior to drilling auxiliary bores, one or more auxiliary well bores may be provided prior to installation of the main liner. Accordingly, other embodiments are within the scope of the following claims.

What is claimed is:

1. A system for lining a junction between a main bore and an auxiliary bore, comprising:

a first tubing adapted to line at least a portion of the main bore, the first tubing having a lateral opening therein; and a second tubing having a junction shield extending outward therefrom, the junction shield having a larger transverse dimension than the lateral opening and wherein the junction shield contracts to smaller transverse dimension to pass through the lateral opening into the auxiliary bore.

2. The system of claim 1 wherein the junction shield contracts by flexing inwardly.

3. The system of claim 1 wherein the junction shield is adapted to expand in the auxiliary bore to substantially cover the lateral opening.

4. The system of claim 1 wherein the junction shield is adapted to expand in the auxiliary bore to a dimension that substantially prevents passage of the junction shield thorough the lateral opening.

5. The system of claim 1 wherein the lateral opening is shaped similar to a projection of the auxiliary bore on the first tubing.

6. The system of claim 1 wherein the junction shield comprises apertures therein adapted to allow for circumferential contraction of the junction shield.

7. The system of claim 1 wherein the junction shield is adapted in substantially cover the lateral opening while allowing passage of specified size particulate between the junction shield and first tubing.

8. The system at claim 1 wherein the second tubing comprises 2-⅞inch nominal sized tubing and wherein the first tubing comprises 5-½inch nominal sized tubing.

9. The system of claim 1 further comprising a lateral opening cover on the first tubing changeable between a closed position coveting at least part of the lateral opening to an open position covering less of the lateral opening than in the closed position.

10. The system of claim 9 wherein the lateral opening cover comprises a tubing received substantially concentrically about the first tubing and is adapted to translate substantially parallel to a longitudinal axis of the first tubing.

11. The system of claim 9 wherein in the closed position, the lateral opening abuts the junction shield of the second tubing.

12. A method of lining a transition between a main bore and an auxiliary bore, comprising:

receiving a main liner in the main bore;

receiving an auxiliary liner in the auxiliary bore, the auxiliary bore at least partially coinciding with a coal seam; and receiving a junction liner between the auxiliary liner and the main liner, the junction liner contracting from a first transverse dimension to a smaller transverse dimension to pass through a lateral opening into the auxiliary bore.

13. The method of claim 12 wherein receiving an auxiliary liner in the auxiliary bore comprises receiving the auxiliary liner carried on a junction running tool; and wherein receiving the junction liner between the auxiliary liner and the main liner comprises receiving the junction liner on the junction running tool.

14. The method of claim 13 further comprising directing the auxiliary liner and junction liner into the auxiliary bore with a whipstock; and further comprising withdrawing the whipstock from the main bore with the junction running tool.

15. The method of claim 13 further comprising directing the auxiliary liner and junction liner into the auxiliary bore with a whipstock; and further comprising relocating the whipstock in the main liner with the junction running tool.

16. The method of claim 12 further comprising:

receiving a second auxiliary liner in a second auxiliary bore; and receiving a second junction liner between the second auxiliary liner and the main liner.

17. The method of claim 12 further comprising closing a cover at least partially over the lateral opening to substantially span a gap between the junction liner and the lateral opening.

18. The method of claim 17 wherein closing the cover comprises engaging the cover with a running tool carrying the junction liner and closing the cover with the running tool.

* * * * *